US007011306B2

(12) United States Patent
Kato et al.

(10) Patent No.: US 7,011,306 B2
(45) Date of Patent: Mar. 14, 2006

(54) SHEET PROCESSING UNIT AND IMAGE FORMING APPARATUS

(75) Inventors: Hitoshi Kato, Tokyo (JP); Wataru Kawata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 10/397,513

(22) Filed: Mar. 27, 2003

(65) Prior Publication Data

US 2003/0184010 A1 Oct. 2, 2003

(30) Foreign Application Priority Data

Apr. 1, 2002 (JP) ..... 2002-098575
Feb. 27, 2003 (JP) ..... 2003-052021

(51) Int. Cl.
*B65H 7/00* (2006.01)

(52) U.S. Cl. ..... 271/256; 271/176

(58) Field of Classification Search ..... 271/256, 271/176, 220, 224, 245, 223, 207
See application file for complete search history.

(56) References Cited

U.S. PATENT DOCUMENTS

| | | | | |
|---|---|---|---|---|
| 6,145,826 | A | 11/2000 | Kawata | 270/58.28 |
| 6,168,147 | B1 | 1/2001 | Nose et al. | 271/10.13 |
| 6,237,910 | B1 | 5/2001 | Kawata | 271/213 |
| 6,241,234 | B1 | 6/2001 | Saitoh et al. | 270/58.12 |
| 6,264,189 | B1 | 7/2001 | Kawata | 271/176 |
| 6,505,829 | B1 | 1/2003 | Kawata | 271/208 |
| 6,572,102 | B1 * | 6/2003 | Vedoy | 271/224 |
| 6,672,586 | B1 * | 1/2004 | Murata et al. | 271/256 |
| 2003/0006548 | A1 | 1/2003 | Murata et al. | 271/256 |
| 2003/0044186 | A1 | 3/2003 | Kato et al. | 399/16 |

FOREIGN PATENT DOCUMENTS

| | | |
|---|---|---|
| JP | 10-181981 | 7/1998 |
| JP | 2001-97631 | 4/2001 |

* cited by examiner

*Primary Examiner*—Donald P. Walsh
*Assistant Examiner*—Kaitlin Joerger
(74) *Attorney, Agent, or Firm*—Fitzpatrick, Cella, Harper & Scinto

(57) ABSTRACT

The present invention discloses a sheet processing unit which can control the timing in conveying successively fed sheets to a sheet ejecting mechanism in accordance with operating conditions. The sheet processing unit comprises a sheet overlapping mechanism which overlaps successively fed sheets together, a conveying mechanism which conveys the sheets from the sheet overlapping mechanism, an ejecting mechanism which ejects the sheets conveyed by the conveying mechanism, and a control unit which electrically controls operations of the sheet overlapping mechanism, the conveying mechanism, and the ejecting mechanism. The control unit changes the number of sheets to be overlapped together at the sheet overlapping mechanism in accordance with information on the conditions for operation of the sheet processing unit inputted from an input unit.

13 Claims, 23 Drawing Sheets

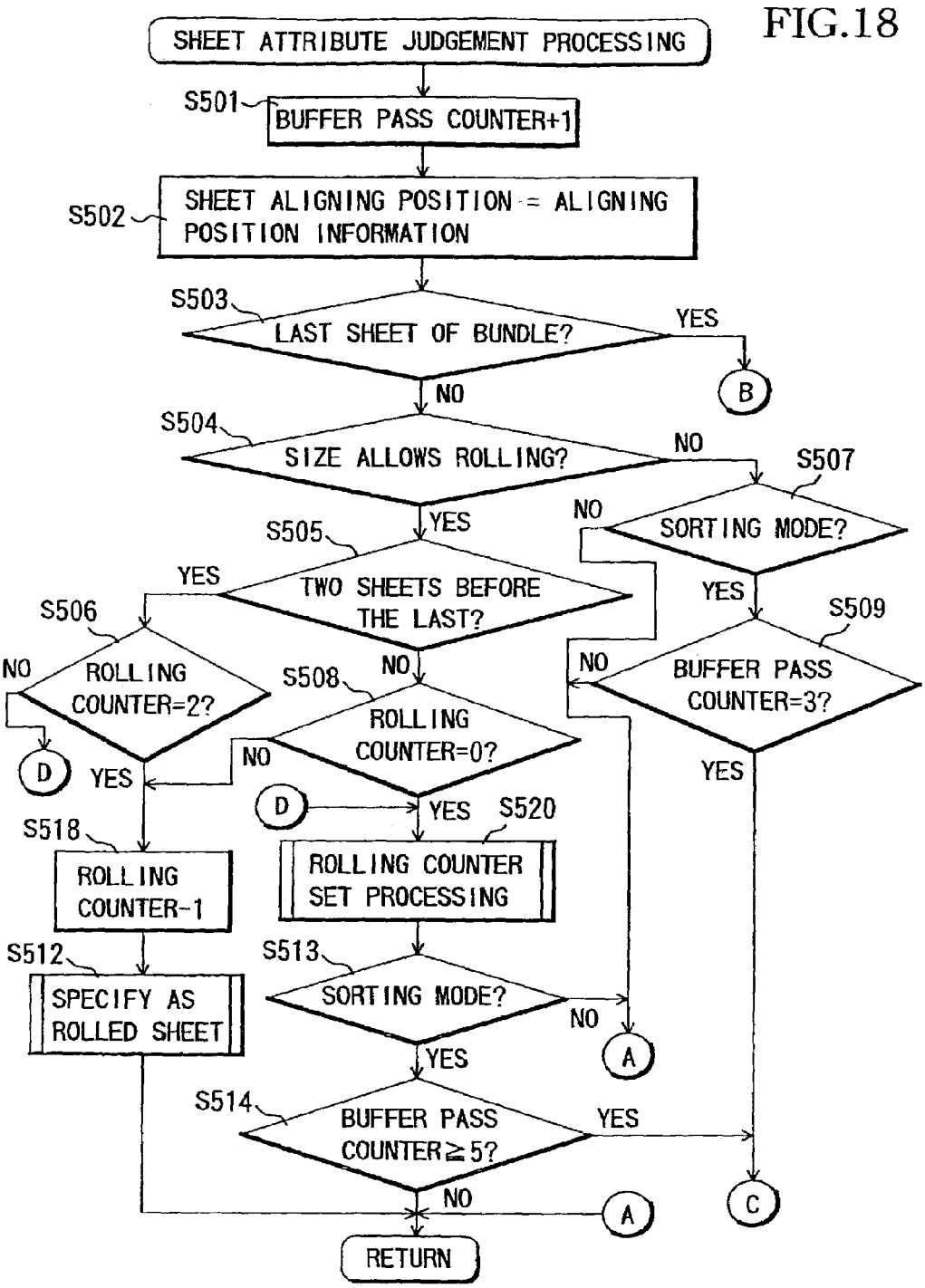
FIG.18
SHEET ATTRIBUTE JUDGEMENT PROCESSING
S501
BUFFER PASS COUNTER+1
S502
SHEET ALIGNING POSITION = ALIGNING POSITION INFORMATION
S503
LAST SHEET OF BUNDLE?
YES
B
NO
S504
SIZE ALLOWS ROLLING?
NO
S507
SORTING MODE?
NO
YES
S505
TWO SHEETS BEFORE THE LAST?
YES
S506
ROLLING COUNTER=2?
NO
D
YES
NO
S508
ROLLING COUNTER=0?
NO
D
YES
S520
ROLLING COUNTER SET PROCESSING
S518
ROLLING COUNTER-1
S512
SPECIFY AS ROLLED SHEET
S513
SORTING MODE?
NO
A
YES
S514
BUFFER PASS COUNTER≧5?
YES
NO
A
C
RETURN
YES
S509
BUFFER PASS COUNTER=3?
NO
YES

SHEET PROCESSING UNIT AND IMAGE FORMING APPARATUS

BACKGROUND OF THE INVENTION

1. Field of the Invention

The present invention relates to a sheet processing unit and an image forming apparatus with the same, and more specifically, a sheet processing unit which aligns and staples sheets that are ejected from an image forming apparatus such as a copying machine or a printer after image forming and an image forming apparatus with the same.

2. Description of the Related Art

Conventionally, a sheet processing unit has been proposed in which sheets ejected from the main body of an image forming apparatus such as a copying machine or a printer, etc., are conveyed one by one onto an ejecting mechanism processing tray and aligned or aligned and stapled (bound), and then ejected onto a stacking tray.

Furthermore, another sheet processing unit has also been proposed in which the first two or three sheets of one sheet bundle to be processed are overlapped together and delivered to bundle ejecting rollers of an ejecting mechanism, and the sheets are butted against a stopper of the processing tray by rotating the bundle ejecting rollers rearward, whereby the plurality of sheets are aligned or aligned and stapled.

However, in an image forming apparatus main body in which sheets are conveyed at small intervals at a high speed to the sheet processing unit, in some cases, the sheet aligning operation or the operation of ejecting sheets onto a tray cannot be completed within the sheet conveying interval.

Furthermore, conveying of sheets at small intervals at a high speed or repetition of the sheet aligning operation for each sheet easily deteriorates the aligning mechanism due to an increase in size of motors in accordance with the high-speed aligning operation or the large number of times of the aligning operation.

Therefore, a sheet processing unit has been proposed which is provided with a sheet stacking mechanism which stacks a predetermined number of sheets successively conveyed from an image forming apparatus main body so that sheets are retained until a predetermined number of sheets are stacked and then conveyed to the ejecting mechanism (Japanese Patent Laid-Open No. 1998-181981).

SUMMARY OF THE INVENTION

An object of the invention is to provide a sheet processing unit and an image forming apparatus in which the timing in conveying successively fed sheets to an ejecting mechanism is controlled in accordance with operating conditions.

In order to achieve the abovementioned object, a sheet processing unit of the invention comprises a sheet overlapping mechanism which overlaps successively fed sheets, a conveying mechanism which conveys the sheets from the sheet overlapping mechanism, an ejecting mechanism which ejects the sheets conveyed from the conveying mechanism, a stacking member on which the sheets ejected from the ejecting mechanism are stacked, and a control unit which electrically controls operations of the sheet overlapping mechanism, the conveying mechanism, and the ejecting mechanism. Furthermore, an input unit which inputs information on a conditions for operation of the sheet processing unit into the control unit is provided. The control unit changes the number of sheets to be overlapped together by the sheet overlapping mechanism in accordance with the information inputted from the input unit.

The foregoing and other features of a sheet processing unit and an image forming apparatus of the present invention will become more readily appreciated as the same becomes better understood with reference to the following detailed description of the embodiments and the accompanying drawings.

BRIEF DESCRIPTION OF THE DRAWINGS

FIG. 18 is a flowchart for describing the operation of sheet attribute judgment processing in the sheet processing unit of FIG. 1.

DETAILED DESCRIPTION OF THE PREFERRED EMBODIMENT

Hereinafter, a preferred embodiment of the invention is described with reference to the drawings.

Figure 10:
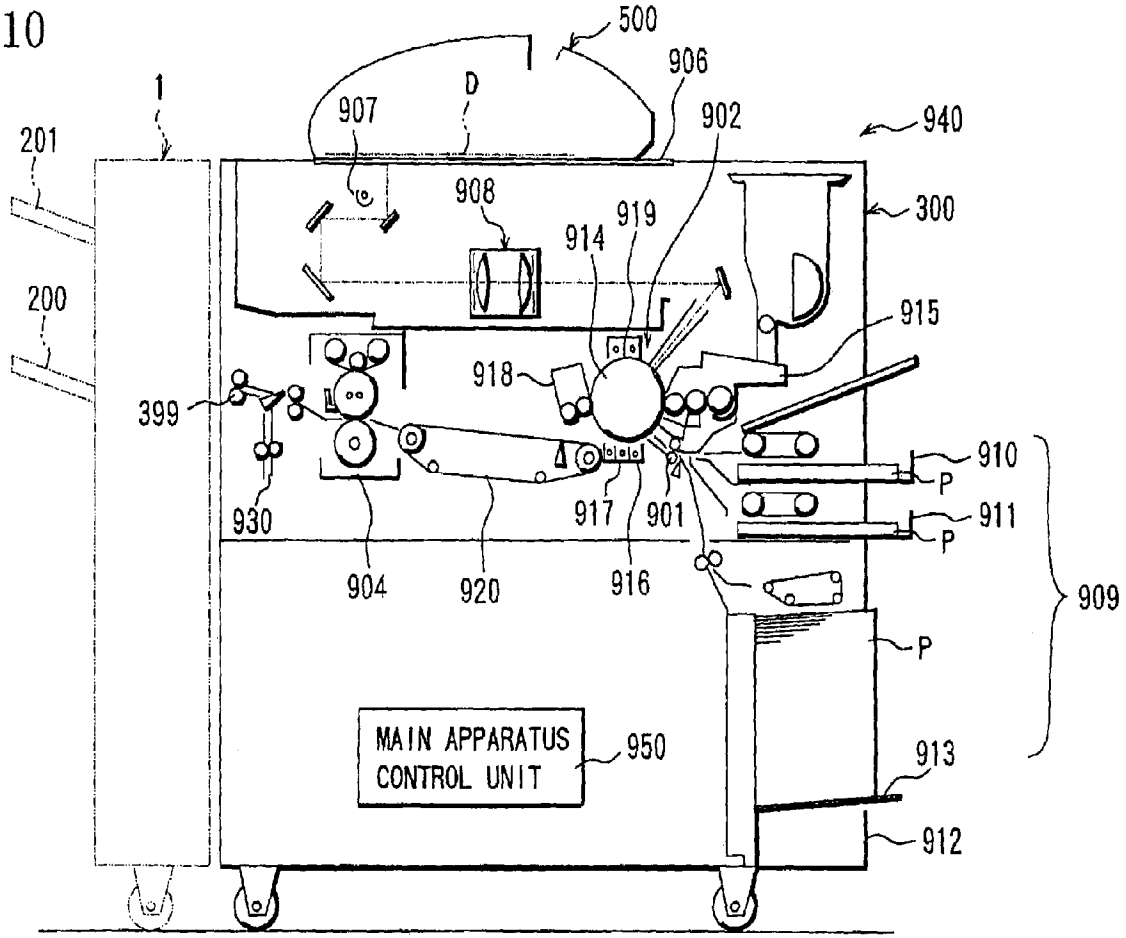
FIG. 10 is a front sectional view of an image forming apparatus main body with the sheet processing unit of FIG. 1.

FIG. 10 shows an example of an image forming apparatus (copying machine) with a sheet processing unit of the invention. The sheet processing unit can be incorporated in not only a printer, but also other image forming apparatuses such as a copying machine, a facsimile, or a complex machine as a part of these apparatuses. Therefore, an apparatus to be incorporated with the sheet processing apparatus of the present embodiment is not limited to a printer.

The numerical values mentioned in this embodiment are approximate reference values, and are not intended to limit the scope of the invention.

(Entire Structure of the Image Forming Apparatus)

In FIG. 10, the main apparatus (main portion of the copy machine) 300 of an image forming apparatus 940 is provided with a document placing base 906 formed of a platen glass, a light source 907, a lens system 908, a sheet feeding unit 909, an image forming unit 902, an automatic document feeder (ADF) 500 which feeds a document to the platen glass 906, and a sheet processing unit which stacks sheets after being formed with images and ejected from the main apparatus 300.

The sheet feeding unit 909 includes cassettes 910 and 911 which house recording sheets P and are detachably attached to the main apparatus 300 and a deck 913 disposed on a pedestal 912. The image forming unit 902 is provided with a cylindrical photosensitive drum 914, a developer 915 around the drum, a transferring charger 916, a detach charger 917, a cleaner 918, and a primary charger 919. At the downstream side of the image forming unit 902, a conveying unit 900, a fixing unit 904, and paired ejecting rollers 399 are disposed.

(Description of the Main Apparatus 300)

Next, the structure and operation of the main apparatus 300 are described.

When a sheet feed signal is outputted from a main apparatus control unit 950 provided in the main apparatus 300, a sheet P is fed from the cassette 910 or 911 or the deck 913. On the other hand, a document D placed on the document placing base 906 is radiated with light from the light source 907, and light reflected on the document D is irradiated onto the photosensitive drum 914 through the lens system 908. The photosensitive drum 914 is charged in advance by the primary charger 919, and an electrostatic latent image is formed on the photosensitive drum 914 by irradiating the light from the document D onto the photosensitive drum 914. Next, the electrostatic image on the photosensitive drum 914 is developed by the developer 915, whereby a toner image is formed.

The sheet fed from the sheet feeding unit 909 is subjected to skewing correction by resist rollers 901, and then further fed to the image forming unit 902 in sync with the operation of the image forming unit 902. In the image forming unit 902, the toner image on the photosensitive drum 914 is transferred onto the fed sheet P by the transferring charger 916. The sheet P with the toner image transferred is charged so as to have a polarity opposite to that of the transferring charger 916, and then separated from the photosensitive drum 914.

The separated sheet P is conveyed to the fixing unit 904 by the conveying unit 920, and the transferred image is fixed to the sheet P by the fixing unit 904. The sheet P with an image fixed is ejected from the main apparatus 300 by paired ejecting rollers 399 in a straight sheet ejecting mode in which the image surface faces up or an inverted sheet ejecting mode in which the sheet is turned upside down during conveyance through a sheet inverting pass 930 so that the image surface faces down.

Thereby, the sheet P fed from the sheet feeding unit 909 is formed with an image and then ejected to a finisher 1 that is a sheet processing unit.

Next, the structure and operation of the finisher 1 are described with reference to FIG. 1.

Figure 1:
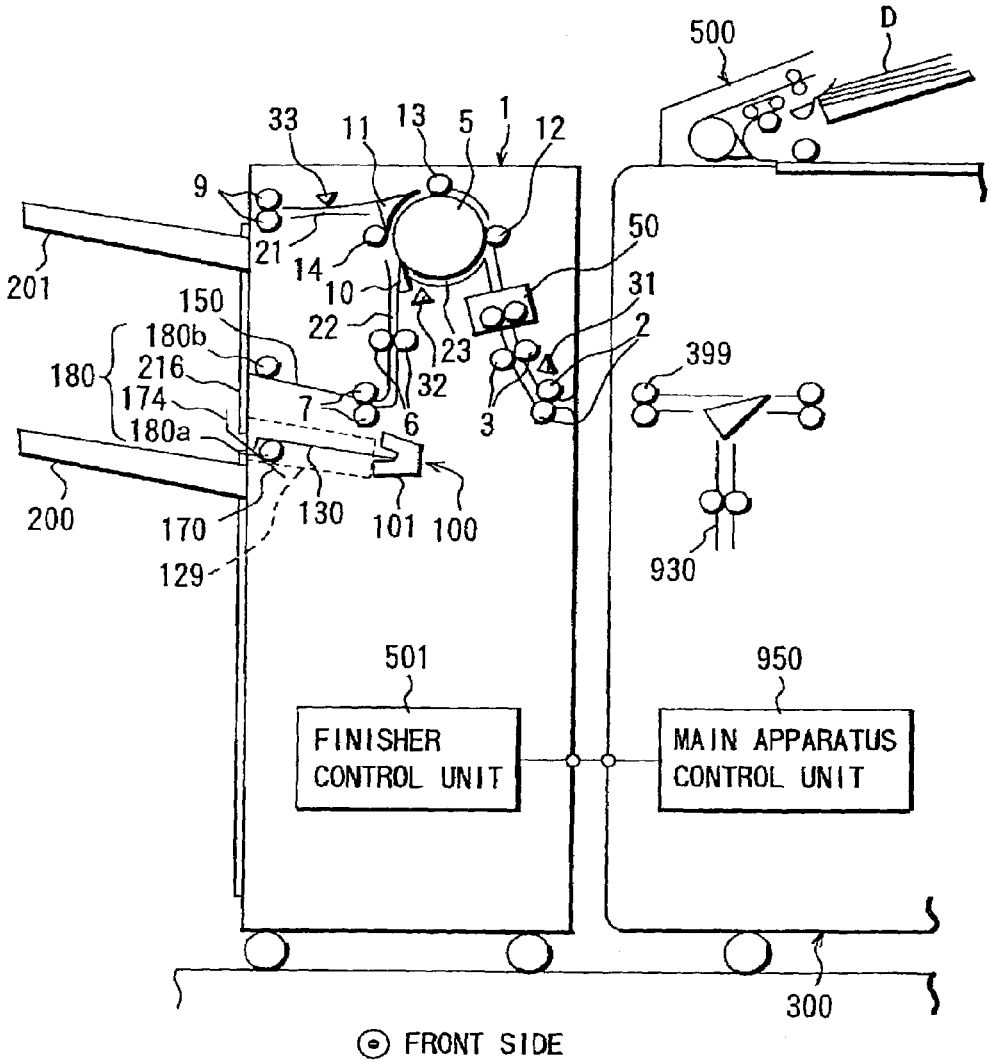
FIG. 1 is a front view showing the entire structure of a sheet processing unit of an embodiment of the invention.

In FIG. 1, a finisher 1 is connected to the side of the main apparatus 300. Detailed description of the main apparatus 300 and the ADF 500 are omitted herein. The ejecting rollers 399 of the main apparatus 300 eject the sheet with an image formed from the main apparatus 300.

Paired gate rollers 2 of the finisher 1 receive the sheet to be fed into the finisher 1 and deliver it into the finisher 1. Paired conveying rollers 3 convey the sheet delivered from the paired gate rollers 2 in the finisher 1. A pass sensor 31 provided at the gate of the finisher 1 detects passage of the sheet. Punching unit 50 perforates holes in the vicinity of the rear end of the conveyed sheet.

Depressing rollers 12, 13, and 14 roll the sheet around the buffer roller 5 by pressing it, and convey and retain the sheet in conjunction with the buffer roller 5. When the next sheet is supplied in the condition where the earlier sheet is winded around the buffer roller 5, these sheets are overlapped together on the buffer roller 5. Namely, the buffer roller 5 and the depressing rollers 12, 13, and 14 form a sheet overlapping mechanism. The sheets overlapped together on the buffer roller 5 are further retained or conveyed to the downstream.

A switching flapper 11 switches a non-sorting pass 21 and a sorting pass 22 which are paths for conveying sheets from the buffer roller 5. A switching flapper 10 switches a buffer pass 23 for temporarily retaining sheets on the buffer roller 5 and the sorting pass 22. Paired conveying rollers 6 provided in the sorting pass 22 convey the sheets to the paired sort ejecting rollers 7.

A processing tray 130 is provided in a processing tray unit 129 disposed below the paired sort ejecting rollers 7. This processing tray 130 is provided for sheet processing before ejection to a stacking tray 200, that is, sheet sorting including alignment after temporary stacking, or stapling aligned sheets by a stapler provided in a stapling unit 100.

The paired sort ejecting rollers 7 eject sheets onto the processing tray 130. Front end butting members 174 receive sheets when the sheets ejected onto the processing tray 130 butt against them.

A bundle ejecting upper roller **180*b* is supported by a swing guide 150, and when the swing guide 150 moves down (rotates to a close position), conveys a bundle of sheets on the processing tray 130 in the bundled condition (hereinafter, this operation is referred to as bundle conveying) and ejects the bundle onto the stacking tray 200 (first stacking member) in conjunction with a bundle ejecting lower roller 180*a* disposed on the processing tray 130 (hereinafter, this operation is referred to as bundle ejection). The bundle ejecting lower roller 180*a* and the bundle ejecting upper roller 180*b* form paired sheet bundle ejecting rollers 180 which eject a sheet bundle on the processing tray 130 onto the stacking tray 200**.

(Description of Stapling Unit 100)

Next, a stapling unit 100 is described with reference to FIG. 2 (front sectional view), FIG. 3 (plan view from the arrow a direction of FIG. 2), and FIG. 4 (back view from the arrow b direction of FIG. 2). In the description given below, the surface side (front side) of the page of FIG. 1 Is expressed as "front" and the back side (deep side) of the same page is expressed as "rear." However, regarding sheets to be conveyed, the front end and the rear end of the sheets are defined in the conveying direction.

A stapler 101 is fixed to a moving base 103 via a holder 102. Rollers 106 and 107 are rotatably attached to shafts 104 and 105 fixed to the moving base 103, and these rollers 106 and 107 are engaged with groove rails 108*a*, 108*b*, and 108*c* formed at a fixed base 108.

The rollers 106 and 107 have flanges 106*a* and 107*a* with diameters larger than the widths of the rails 108*a*, 108*b*, and 108*c* of the fixed base 108. On the other hand, below the moving base 103, supporting rollers 109 are provided at three positions. The moving base 103 supporting the stapler 101 can move in the front and rear direction with respect to the fixed base 108 by the engagement between the rollers 106 and 107 and the rail 108*a* extending front and rearward and rolling of the supporting rollers 109 on the fixed base 108.

Figure 3:
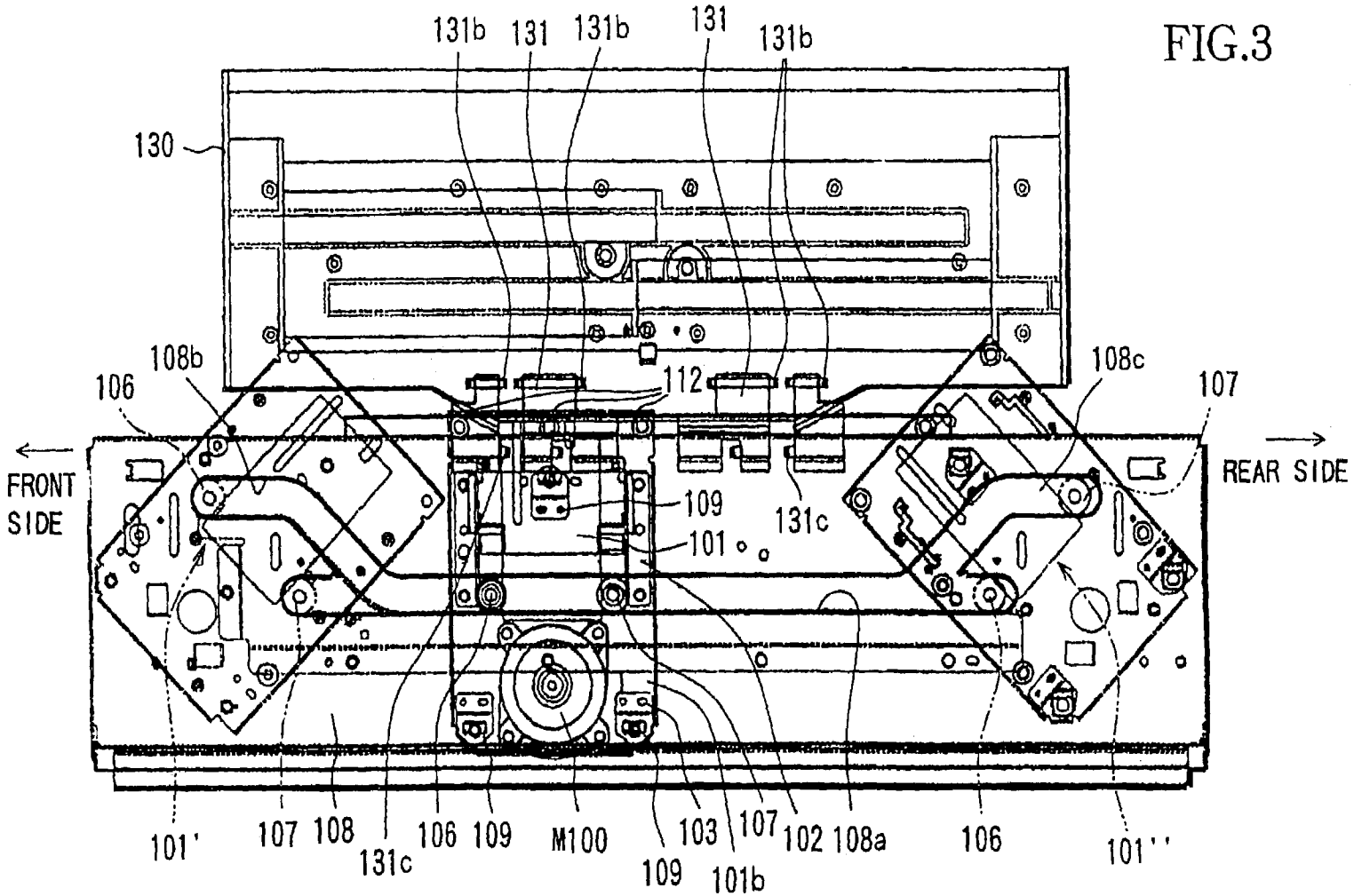
FIG. 3 is a plan view of a stapler moving mechanism viewed from the arrow a direction of FIG. 2.

As shown in FIG. 3, the rails 108*b* and 108*c* are branched toward the sheet ejecting direction (leftward in the figure) from the rail 108*a* at the front portion and the rear portion, and the foremost ends and the rearmost ends of these rails extend front and rearward, respectively.

With this rail structure, when the stapler 101 locates at the central portion in the front and rear direction, both the rollers 106 and 107 engage with the rail 108*a*, and the stapler 101 is in the parallel condition shown by solid lines in the figure. When the stapler 101 moves front from this condition, the roller 106 engages with the rail 108*b* and the roller 107 engages with the rail 108*a*, and then the stapler reaches the foremost end, the stapler 101 becomes aslant against the front and rear direction as indicated by the reference numeral 101' in the figure.

On the other hand, when the stapler 101 is moved rearward from the central portion, the roller 106 engages with the rail 108*a* and the roller 107 engages with the rail 108*c*, and when the stapler reaches the rearmost end, as shown by the reference symbol 101" in the figure, the stapler becomes aslant to the side opposite to the condition where the stapler is positioned at the foremost end in the front and rear direction.

During movement of the rollers 106 and 107 along the portions of the rails 108*b* and 108*c* extending front and rearward, the stapler 101 moves parallel front and rearward while maintaining its posture aslant against the front and rear direction. Thereby, stapler 101 can be moved to a staple position suitable for the sheet width, and either one-point (left or right) stapling or two-point stapling can be selected.

Furthermore, switching of the rail to be engaged with the roller 106, that is, a change in the direction of the stapler 101 is carried out by action of a cam that is not shown.

Next, the moving mechanism of the stapler 101 is described.

Figure 4:
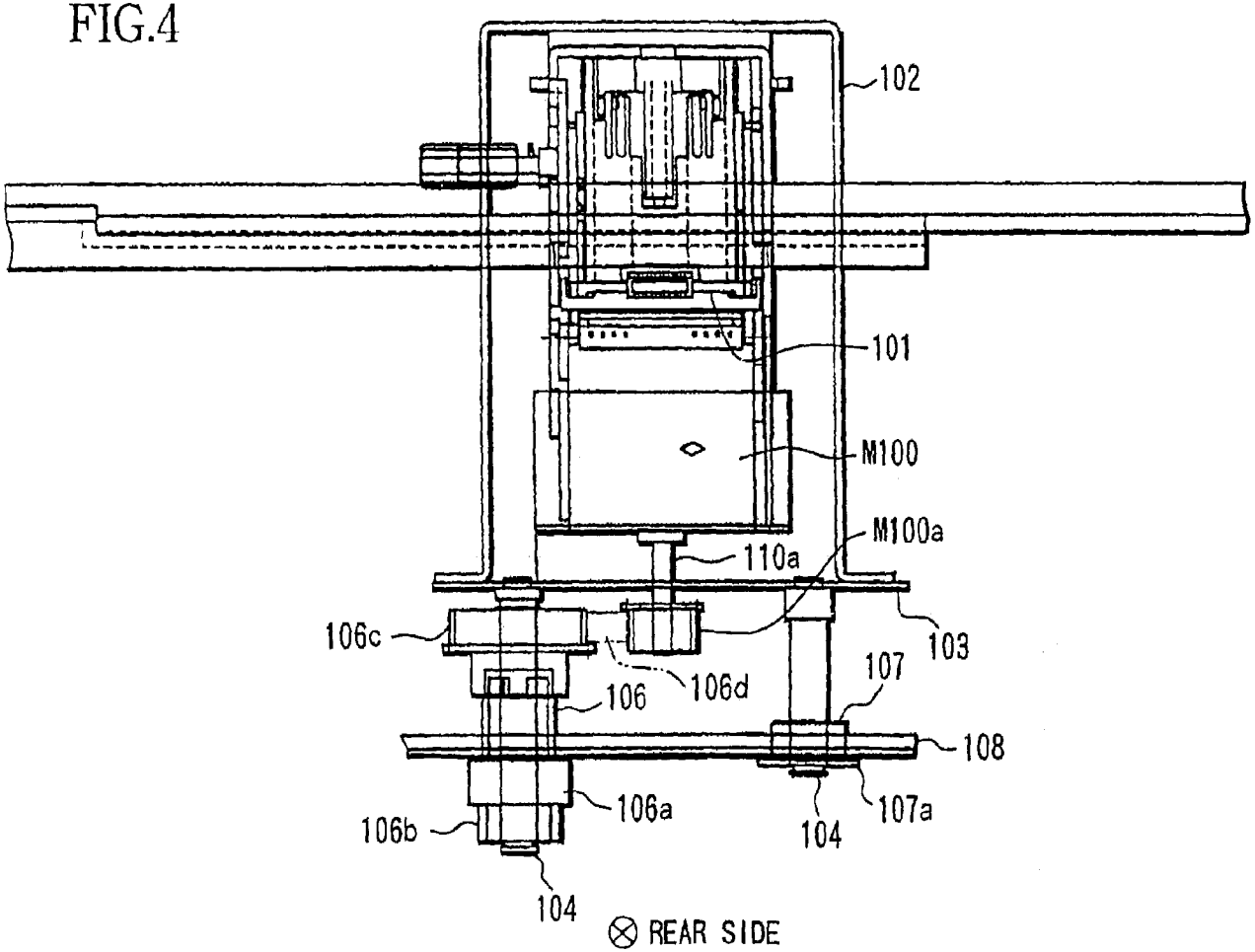
FIG. 4 is a back view of the stapler moving mechanism viewed from the arrow b direction of FIG. 2.

As shown in FIG. 4, for the roller 106 attached to the moving base 103, a pinion gear 106*b* and a belt pulley 106*c* are integrally formed, and to this pinion gear 106*b*, a drive force of a motor M100 fixed above the moving base 103 is transmitted via the belt 106*d* suspended around the pulley 106*c*.

On the other hand, a rack gear 110 to engage with the pinion gear 106*b* is fixed to the lower surface of the fixed base 108 so as to extend front and rearward, whereby the moving base 103 moves front and rearward together with the stapler 101 in response to front and rearward rotation of the motor M100.

Furthermore, a shaft 111 extending from the upper surface to the lower surface of the moving base 103 is provided with a stopper push-down roller 112. This stopper push-down roller 112 has a function for rotating a rear end stopper 131 of the processing tray 130 in order to avoid collision between the rear end stopper 131 and the stapler 101, and details of this are described later.

Furthermore, the stapler unit 100 is provided with a sensor (not shown) to detect the home position of the stapler 101 (foremost in the embodiment), and the stapler 101 is normally on standby at the home position.

Next, the rear end stopper 131 which supports the rear ends of sheets stacked on the processing tray 130 is described with reference to FIG. 2 and FIG. 4.

The rear end stopper 131 has a supporting surface 131*a* that is roughly perpendicular to the stacking surface of the processing tray 130 and supports the rear ends of sheets, a pin 131*b* which is fitted in a circular hole formed in the processing tray 130 and makes it possible for the rear end stopper 131 to swing, and a pin 131*c* which engages with a link that is described as follows. The link comprises a main link 132 having a cam surface 132*a* with which the roller 112 attached to the moving base 132*b* comes into contact and a joint link 133 which joins a pin 132*b* provided at the upper end of the main link 132 and the pin 131*c* of the rear end stopper 131.

The main link 132 swings pivotally around a shaft 134 fixed to the frame (not shown) of the finisher 1. Furthermore, a drawing spring 135 which presses the main link 132 clockwise is provided between the lower end of the main link 132 and the frame. Normally, the main link 132 is positioned by butting against a butting plate 136 by a pressing force of the drawing spring 135. In this case, the rear end stopper 131 maintains its posture perpendicular to the processing tray 130.

Figure 2:
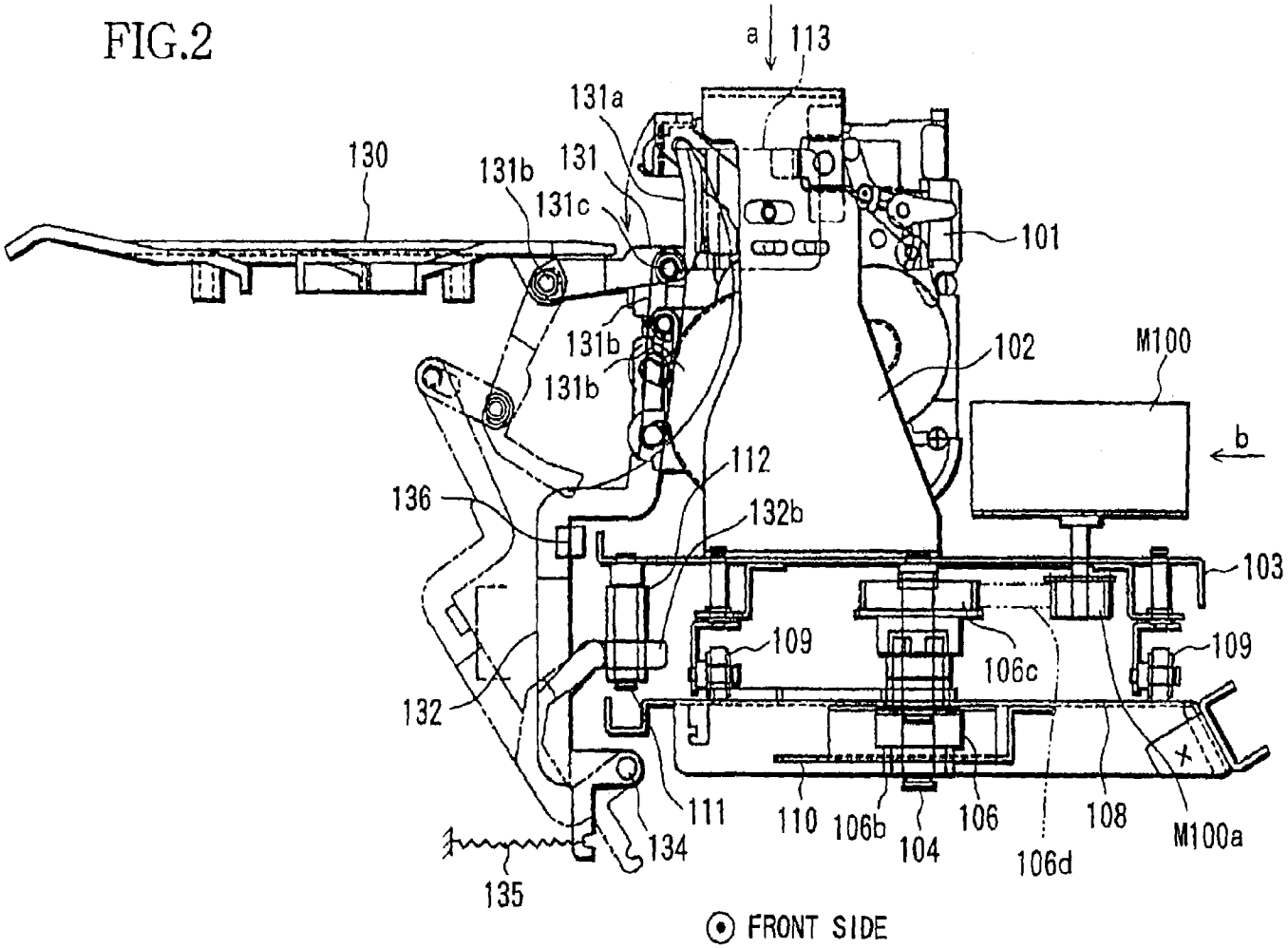
FIG. 2 is a side view of a portion including a stapler and a processing tray in the sheet processing unit of FIG. 1.

When the stapler 101 moves from the central portion to the front portion or the rear portion, the cam surface 132*a* of the main link 132 joined to the rear end stopper 131 is pressed by the stopper push-down roller 112 provided at the moving base 103, and the main link 132 is pushed down to the position shown by an alternate long and short double dashed line in FIG. 2. Thereby, the rear end stopper 131 is drawn by the joint link 133 and rotated to a position that does not interfere with the stapler 101. The number of stopper push-down rollers 112 provided is plural (three in this embodiment) so that the rear end stopper 131 maintains this avoidance position.

On both side surfaces (front and rear surfaces) of the holder 102 supporting the stapler 101, stapling stoppers 113 (shown by alternate long and short double dashed line in FIG. 2) having a supporting surface with the same shape as that of the rear end stopper 131 are provided. Therefore, even while the stapler 101 presses the rear end stopper 131 at the central portion, the stapling stopper 113 can support the rear ends of sheets.

(Description of Processing Tray Unit 129)

Next, the processing tray unit 129 is described with reference to FIG. 5.

The processing tray unit 129 is disposed between the paired sort ejecting rollers 7 which convey sheets that have fed through the sorting pass 22 and eject them from the sorting pass 22 and the stacking tray 200 which receives and houses a bundle that has been processed by the processing tray 130.

The processing tray unit 129 comprises the processing tray 130, the rear end stopper 131, an aligning unit 140, the swing guide 150, a draw-in paddle 160, an advancing and withdrawing tray 170, and the paired bundle ejecting rollers 180.

The processing tray 130 is a tray that is inclined so that the downstream side locates upward (left side of FIG. 5) and the upstream side locates downward (right side of FIG. 5), and at the lower end of the processing tray, the abovementioned rear end stopper 131 is attached in a manner enabling it to swing up and down. The sheets ejected from the paired sort ejecting rollers 7 are slid on the processing tray 130 until the rear ends Pr thereof come into contact with the rear end stopper 131 by action of a weight described later and the draw-in paddle 160.

Furthermore, the bundle ejecting lower roller 180*a* is provided at the upper end of the processing tray 130, and the bundle ejecting upper roller 108*b* that comes into contact with the bundle ejecting lower roller 108*a* is provided at the swing guide 150 described later. These paired bundle ejecting rollers 108 can rotate front and rearward in response to drive of the motor M180.

(Description of Aligning Unit 140)

Next, the aligning unit 140 is described with reference to FIG. 5 and FIG. 6 that is a bottom plan view from the arrow c direction of FIG. 5.

Aligning members 141 and 142 provided at the front side and rear side of the aligning unit 140 are movable front and rearward independently from each other. The front aligning member 141 and the rear aligning member 142 comprise, respectively, aligning surfaces 141*a* and 142*a* which stand to press the sheet side end faces, supporting surfaces which are bent from the lower sides of the aligning surfaces 141*a* and 142*a* so as to be horizontal and support the lower surface of the sheet P, and gear portions 141*b* and 142*b* formed with rack gears. These two aligning members 141 and 142 are supported and guided by groove guides 130*g* that are formed to extend front and rearward in the processing tray 130, and are assembled so that aligning surfaces 141*a* and 142*a* are exposed to the upper surface of the processing tray 130 and gear portions 141*b* and 142*b* are exposed to the lower surface of the processing tray 130.

The gear portions 141*b* and 142*b* are engaged with pinion gears 143 and 144 provided below the processing tray 130, separately. Drive forces of motors M141 and M142 are transmitted to the pinion gears 143 and 144 via pulleys and belts that are not shown. Therefore, the aligning members 141 and 142 move front and rearward in response to front and rearward rotation of the motors M141 and M142. The aligning unit 140 is provided with sensors (not shown) which detect the home positions of the aligning members 141 and 142, and the aligning members 141 and 142 are normally on standby at the home positions.

In this embodiment, the home position of the front aligning member 141 is set foremost, and the home position of the rear aligning member 142 is set rearmost.

The swing guide 150 supports the bundle ejecting upper roller 180*b* at the downstream side (left side of FIG. 5), and the upstream side (right side of FIG. 5) is supported by a swing pivot shaft 151 fixed to the frame (not shown) of the finisher 1. Normally, when the sheets P are ejected onto the processing tray 130 one by one, the swing guide 150 is in an opened condition (where the paired bundle ejecting rollers are separated vertically from each other) so as not to interfere with ejection and dropping of the sheets onto the processing tray 130 and sheet alignment. On the other hand, when the sheets are bundled and ejected onto the stacking tray 200 from the processing tray 130, the swing guide 150 closes (sheets are nipped between the paired bundle ejecting rollers 180).

A rotating cam 152 is positioned opposite to the lower surface of the side plate of the swing guide 150, and when the rotating cam 152 rotates and pushes up the side plate of the swing guide 150, the swing guide 150 swings upward pivotally around the shaft 151 and opens. When the rotating cam 152 rotates by 180 degrees from this condition and the cam surface separates from the side plate of the swing guide 150, the swing guide 150 closes. The rotating cam 152 is driven to rotate by a motor M150 via a drive system that is not shown.

Furthermore, the closed condition of the swing guide 150 is regarded as its home position, and a sensor for detecting this home position is provided (not shown) in the processing tray unit 129.

Next, the draw-in paddle 160 is described.

The draw-in paddle 160 is fixed to a paddle shaft 161 that is rotatably supported on the frame (not shown) of the finisher 1. The paddle shaft 161 is joined to a motor M160, and rotates counterclockwise while being accompanied by the draw-in paddle 160 when it receives a drive force from the motor M160. The draw-in paddle 160 is formed from an elastic material, and the length thereof is set slightly longer than the vertical distance between the paddle shaft 161 and the processing tray 130. The home position of the draw-in paddle 160 is set to a position which prevents contact with the sheets P ejected onto the processing tray 130 by the paired sort ejecting rollers 7 (position shown by a solid line in the figure).

Figure 5:
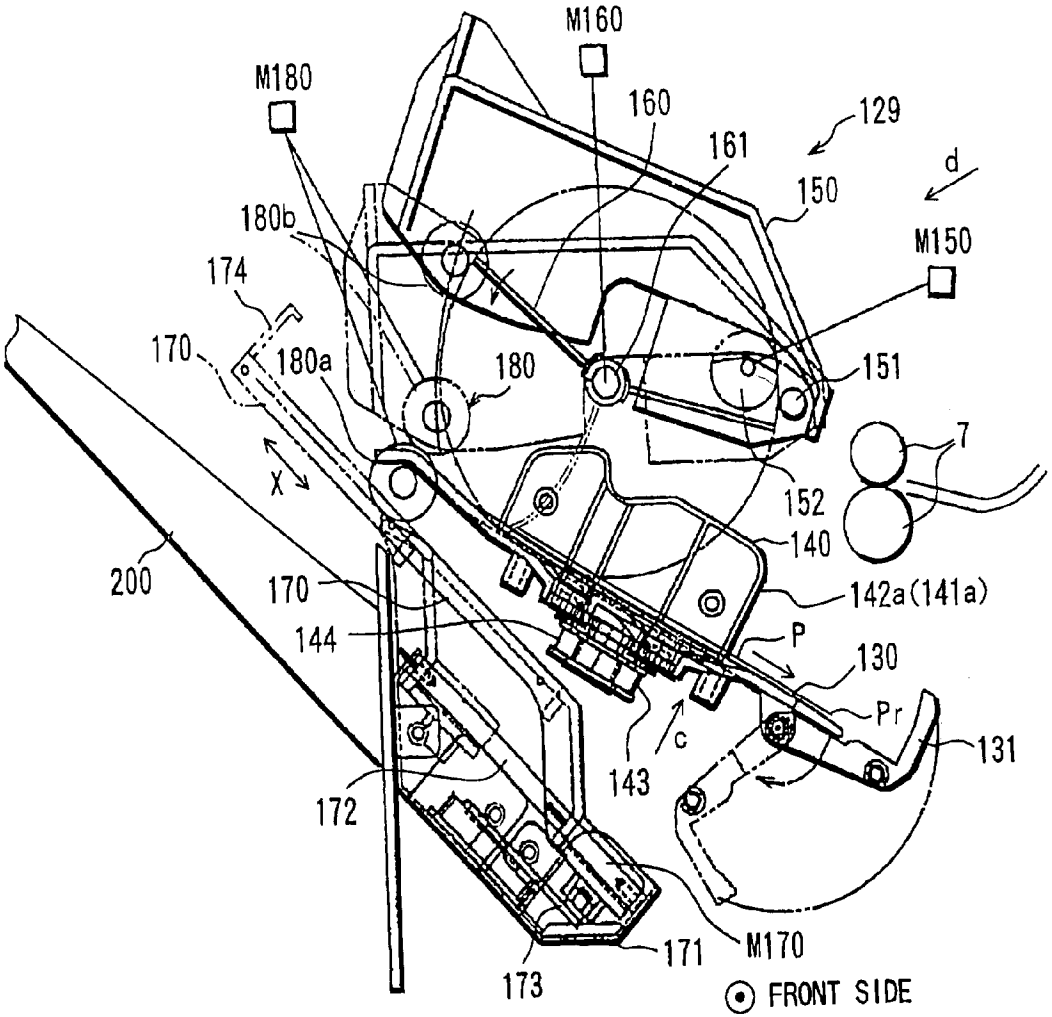
FIG. 5 is a front sectional view of a swing guide and the processing tray in the sheet processing unit of FIG. 1.
Figure 6:
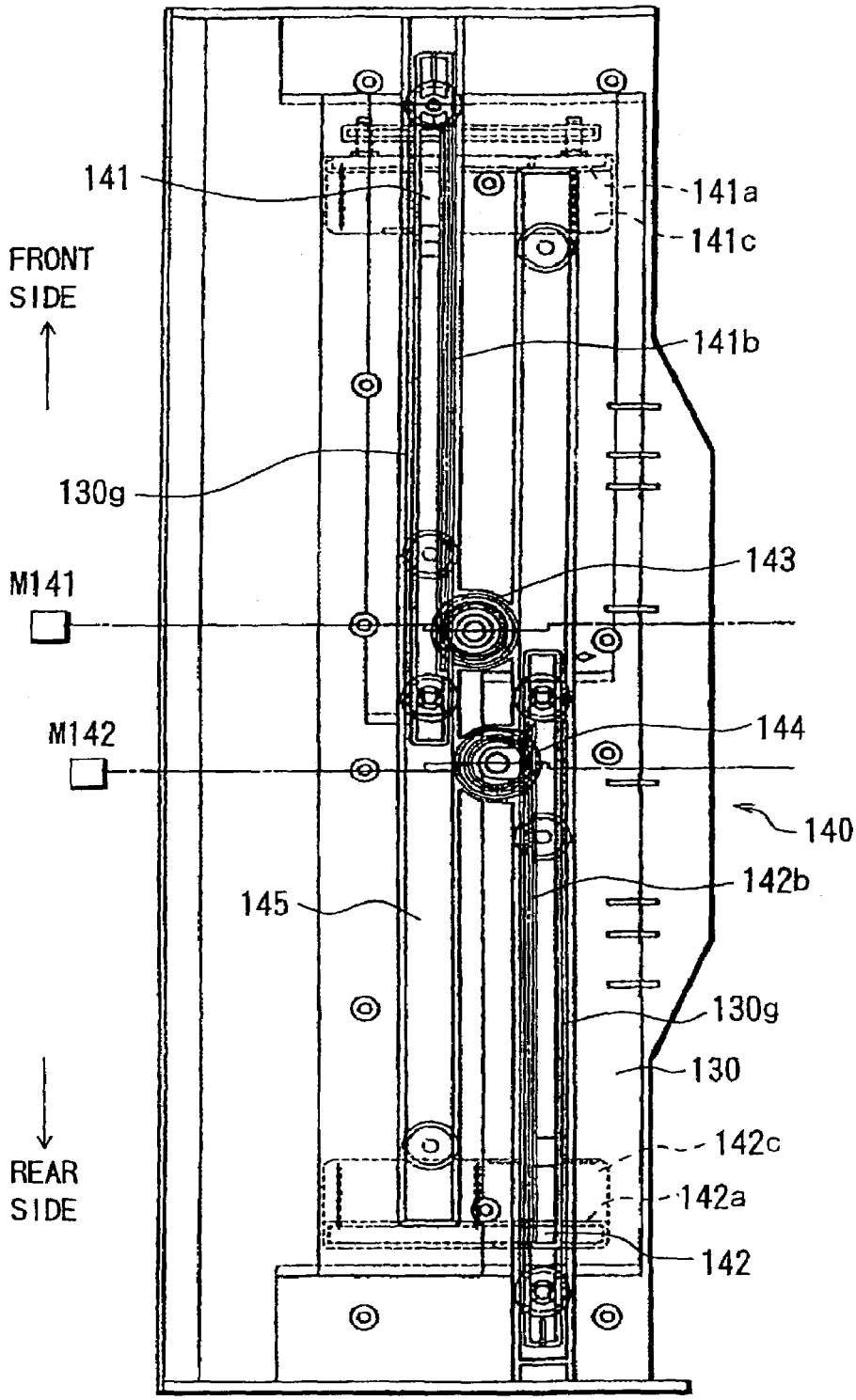
FIG. 6 is a bottom plan view of the processing tray and an aligning unit in the sheet processing unit of FIG. 1.

The sheets P are ejected onto the processing tray 130 in this condition, and when the sheets P land on the processing tray 130 (the rear ends Pr of the ejected sheets P land on a position separated from the rear end stopper 131), the draw-in paddle 160 rotates counterclockwise in response to a drive force from the motor M160 and moves while elastically deforming on the processing tray 130 as shown by an alternate long and short double dashed line in FIG. 5 to push back the sheets P until the rear ends Pr of the sheets come into contact with the rear end stopper 131 (draw-in the sheets to the upstream side in the ejecting direction). Thereafter, after a predetermined period of time, the draw-in paddle 160 stops at the home position and prepares for the next sheet ejection.

Figure 7:
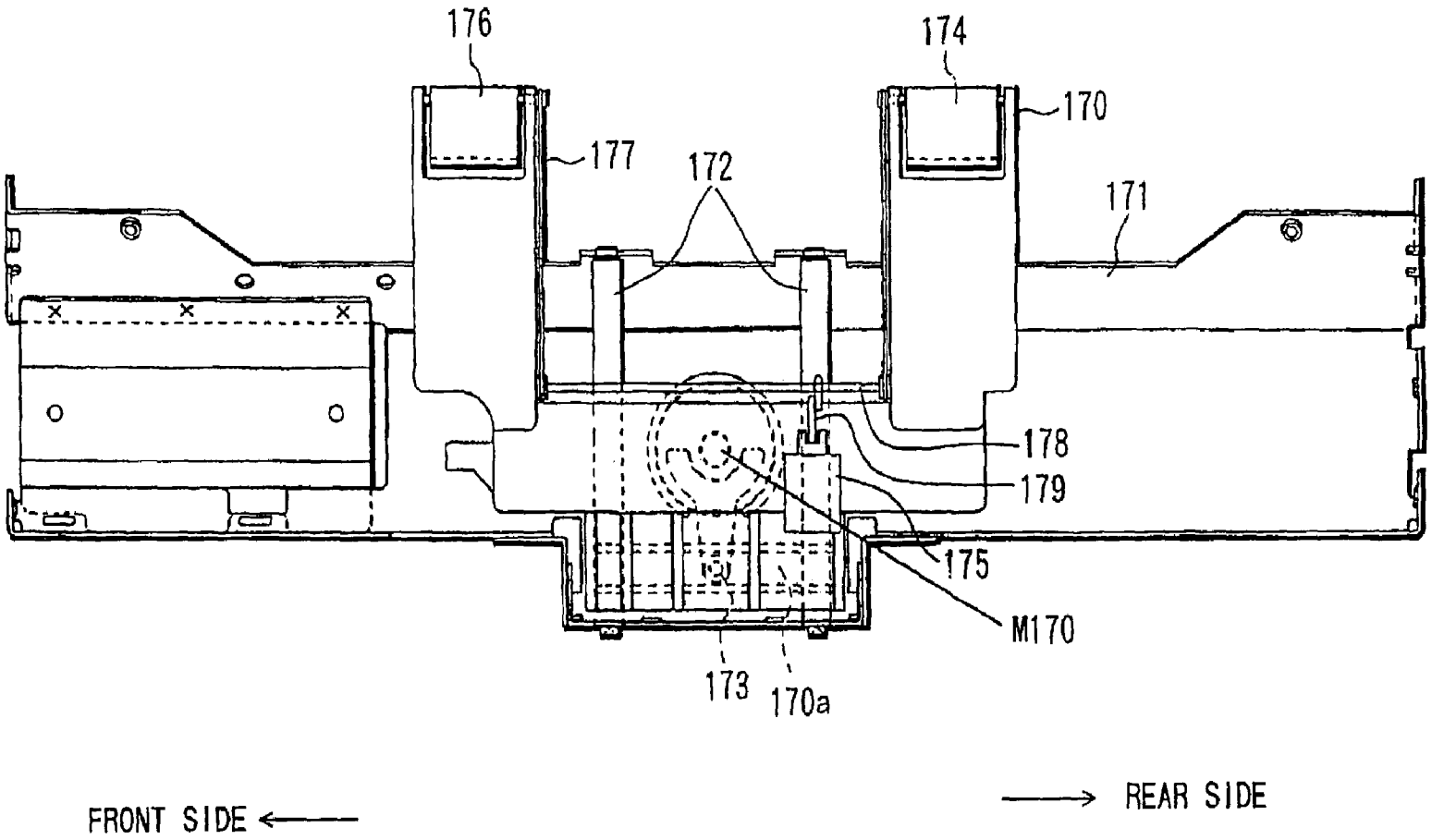
FIG. 7 is a plan view of an advancing and withdrawing tray in the sheet processing unit of FIG. 1.

Next, the advancing and withdrawing tray 170 is described with reference to FIG. 5 and FIG. 7 that is a view from the arrow d direction of FIG. 5.

The advancing and withdrawing tray 170 is positioned below the bundle ejecting lower roller 180*a*, and advances and withdraws in the sheet conveying direction (x direction) while following the inclination of the processing tray 130. The advancing and withdrawing tray 170 extends its front end to the left side of the figure along the stacking tray 200 in its advancing condition, and withdraws the front end further rightward than the pared bundle ejecting rollers 180 in the figure (shown by a solid line in FIG. 5) in its withdrawing condition. The front end position of the advancing and withdrawing tray 170 when it advances is set so as not to be exceeded by the gravity of the sheets P ejected onto the processing tray 130 even when the sheets P are large in size (A3).

The advancing and withdrawing tray 170 is supported by rails 172 that is fixed to the frame 171 in a manner enabling the advancing and withdrawing tray to move in the sheet ejecting direction. A rotating link 173 rotates around the output shaft of an advancing and withdrawing tray drive motor M170, and engages with a guide groove 170*a* that is provided at the lower surface of the advancing and withdrawing tray 170 and extends in a direction orthogonal to the sheet ejecting direction. Therefore, the advancing and withdrawing tray 170 advances to an advanced position or withdraws to a withdrawn position by one full turn of the rotating link.

Furthermore, the rotation of the advancing and withdrawing tray drive motor M170 is transmitted to the rotating link 173 via a drive mechanism that is not shown. Furthermore, the home position of the advancing and withdrawing tray 170 is set to the withdrawn position, and is detected by a sensor that is not shown.

In a case where the size of sheets ejected from the paired sort ejecting rollers 7 is small, the advancing and withdrawing tray 170 is at the advanced position, and when a solenoid 175 for driving the front end butting members 174 actuate in this condition, a shaft 178 rotates via a link member 179, and the front end butting members 174 are rotated around rotation shafts 176 by drive belts 177 to a butting position to stand up roughly perpendicularly to the stacking surface of the processing tray 130.

Therein, the front end butting members 174 are made to stand up only in the case where the sheets are small in size (herein, 220 mm or less). The reason for this is that, if the front ends of large-sized sheets ejected from the paired sort ejecting rollers 7 are butted against the front end butting members, the front end butting members need to locate at the front side of the ejected sheets, and this results in an increase in size of the apparatus. Furthermore, in order to downsize the apparatus, it is required to increase the inclination of the processing tray 130, and this hardly satisfies aligning performance and stacking performance in the case of Z-folded sheets, flexible large-sized sheets, etc.

Figure 8:
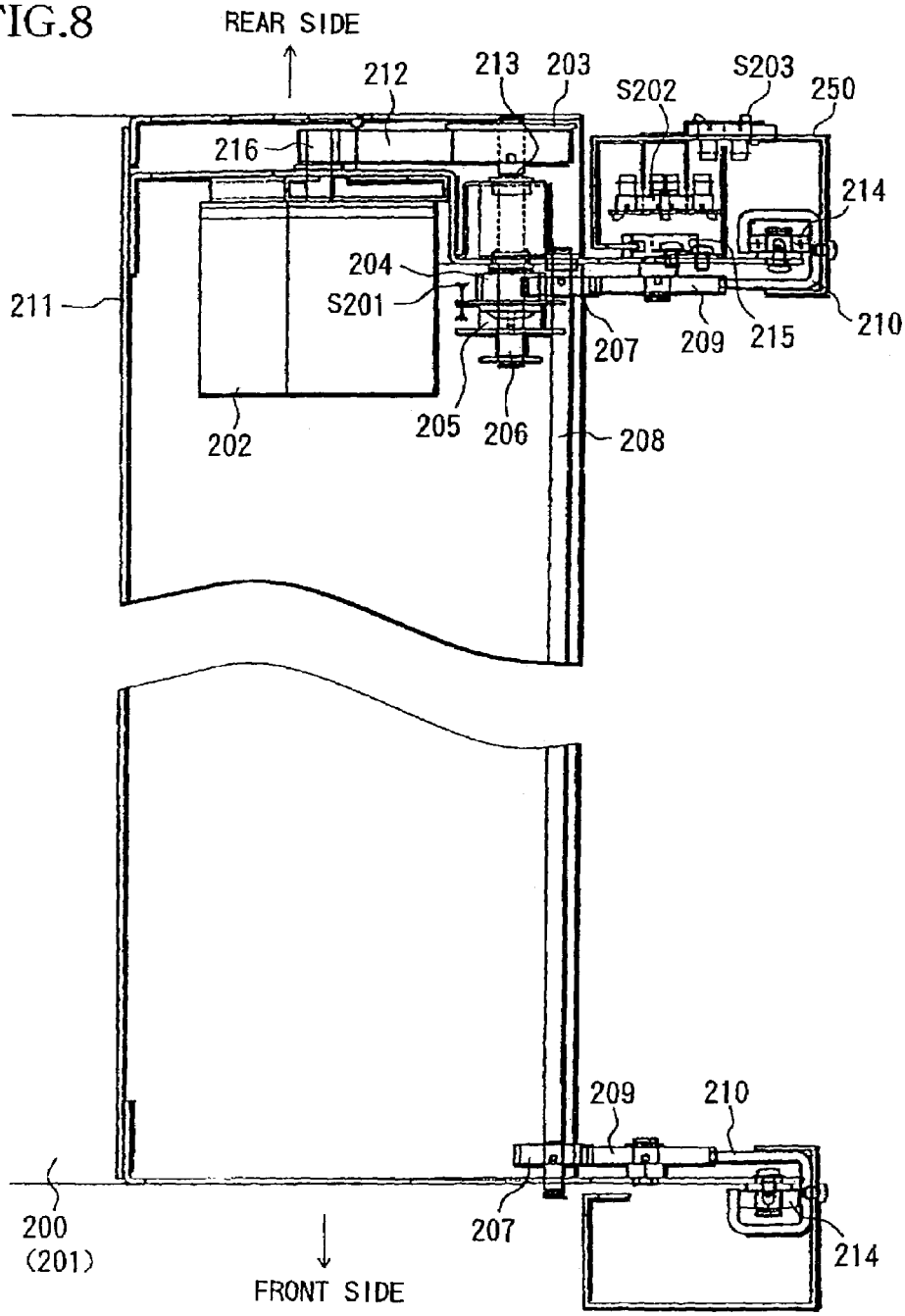
FIG. 8 is a plan view of a stacking tray moving mechanism in the sheet processing unit of FIG. 1.
Figure 9:
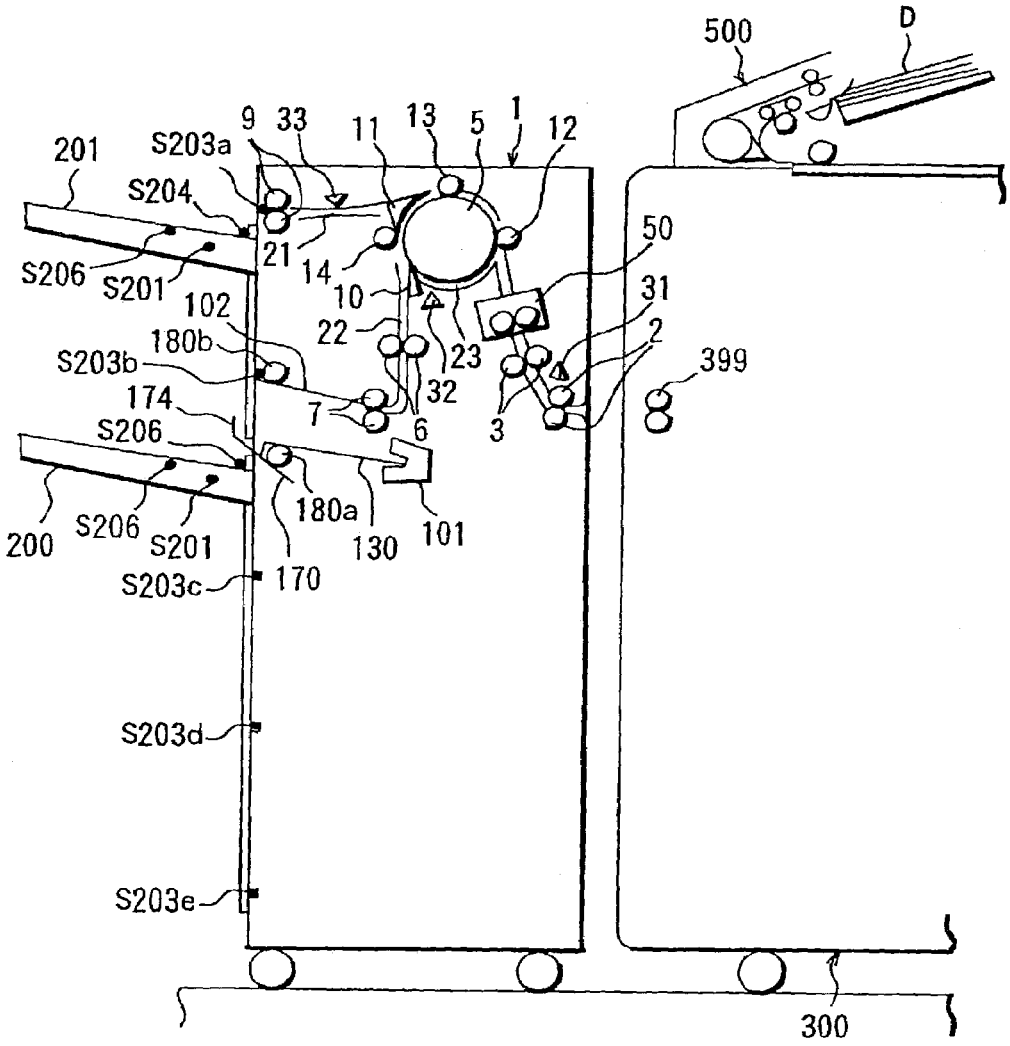
FIG. 9 is a layout drawing of sensors around the stacking tray in the sheet processing unit of FIG. 1.

Next, the stacking tray 200 (first stacking member) and a sample tray (second stacking member) 201 are described based on FIG. 8 and FIG. 9.

These two trays 200 and 201 have tray drive motors (for example, stepping motors) 202, respectively, and are attached to racks 210 that are attached to the frame 250 of the finisher 1 so as to extend vertically. Furthermore, the racks 210 simultaneously serve as roller receivers for receiving the rollers 214 that are provided for the trays 200 and 201. When the motor 202 is driven, the output of the motor is transmitted by a transmission mechanism described later to gears 209 that engage with the racks 215. Thereby, the trays 200 and 201 can independently rise and lower.

Furthermore, a regulating member 215 suppresses play in the front and rear direction of the trays 200 and 201. The tray drive motors 202 are attached to a tray base plate 211, and a pulley press-fitted with the output shaft of the motor 202 drives a pulley 203 via a timing belt 212.

A shaft 213 joined to the pulley 203 by a parallel pin transmits a drive force to a ratchet 205 that is also joined to the shaft 213 by a parallel pin, and the ratchet 205 is pressed against an idler gear 204 by a spring 206. The ratchet 205 transmits the drive force to the idler gear 204 due to the connection to the idler gear 204. The idler gear 204 is connected to gears 207. The gears 207 are disposed at both front and rearward sides and are joined to each other by a shaft 208. The front and rear gears 207 transmit the drive force to the gears 209 that are also provided at both front and rearward sides and engage with the front and rear racks 210. Thereby, the trays 200 and 201 rise and lower along the racks 210. The trays 200 and 201 are attached with two rollers 214 each at upper and lower sides of the front and rearward portions thereof, and these rollers are housed in the racks 210 that simultaneously serve as roller receivers. The trays are attached onto the tray base plate 211 and form a tray unit.

When the trays 200 and 201 lower, in order to prevent foreign matter from being caught between the trays and a floor surface and causes the tray drive system to break, the racket 205 pushes the spring 206 aside and idles when a load over a predetermined load is applied. In this idling, a sensor S201 that immediately stops the drive of the motor 202 detects a slit of a slit plate (not shown) incorporated in the idler gear 204. This sensor S201 is also used as an out-of-step detector.

The swing guide 150 becomes a part of the stacking wall of the stacking tray 200 when the swing guide 150 is at the closed position. The stacking tray 202 can rise and lower only when a sensor that is not shown detects that the swing guide 150 is at the closed position.

Furthermore, a sensor S202 shown in FIG. 8 is an area detecting sensor which detects whether or not the sample tray 201 is positioned within an area from the position at which an upper limit sensor 203*a* (see FIG. 9) to detect excessive rising of the sample tray 200 to the position close to the height of the bundle ejecting lower roller 180*a*, at which a tray sheet surface detecting sensor S205 is provided.

A 1000-sheet position detecting sensor S203*b* for the sample tray 201 shown in FIG. 9 is disposed at a position corresponding to 1000 sheets from a position at which a non-sorting sheet surface detecting sensor S204 is provided, and is for limiting the sheet stacking amount on the sample tray 201 by height.

A sensor S203*c* is for limiting the stacking amount of sheets which the stacking tray 200 receives from the processing tray 130 by height, and is disposed at a position corresponding to 1000 sheets from the position at which a tray sheet surface detecting sensor S205 is provided.

A sensor S203*d* is for limiting the stacking amount of sheets that the stacking tray 200 receives from the processing tray 130 by height, and is disposed at a position corresponding to 2000 sheets from the position at which the tray sheet surface detecting sensor S205 is provided. A sensor S203*e* is a lower limit sensor which detects excessive lowering of the stacking tray 200. Among the abovementioned sensors, the sheet surface detecting sensors S204 and S205 are transmission sensors each having a light projecting portion and a light receiving portion separately at the front side and rearward side. Furthermore, a sheet existence detecting sensor S206 is disposed at each tray.

As a method for detecting the sheet surface, a condition where the optical axes of the sheet surface detecting sensors S204 and S205 are positioned a predetermined distance (for example, 1 mm) above each tray or the uppermost surface of sheets on each tray is defined as an initial status, and the tray is made to lower by a predetermined distance for each sheet stacking so that the concealed optical axes of the sheet surface detecting sensors S204 and S205 are exposed after each sheet stacking.

(Description of Control Unit)

Next, control circuitry for controlling the image forming apparatus of this embodiment is described with reference to FIG. 1 and FIG. 11. As shown in FIG. 1, the control circuit of the image forming apparatus comprises a main apparatus control unit 950 loaded in the main apparatus 300 and a finisher control unit 501 loaded in the finisher 1.

Figure 11:
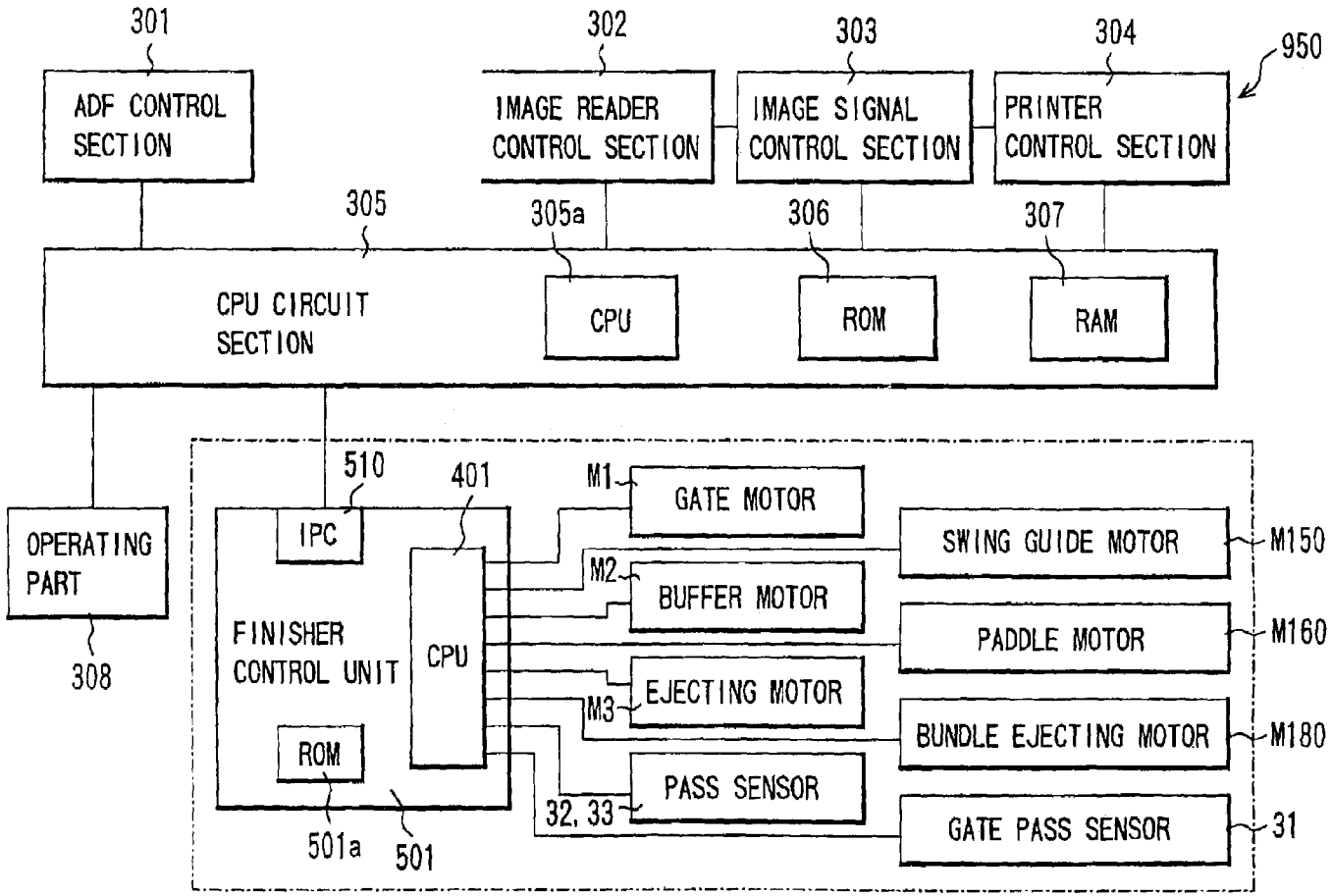
FIG. 11 is a block diagram showing the electric circuitry of the sheet processing unit of FIG. 1.

In FIG. 11, a section other than a section circled by an alternate long and short dashed line shows the main apparatus control unit 950 that administers control of the main apparatus 300, and the section circled by an alternate long and short dashed line shows circuits loaded in the finisher 1. Among these, the reference numeral 501 indicates the finisher control unit which administers control of the finisher 1.

The main apparatus control unit 950 has a CPU circuit section 305 as shown in FIG. 11. The CPU circuit section 305 includes a CPU 305*a*, a ROM 306, and a RAM 307, and collectively control the sections 301, 302, 303, 304, and 308 that are described later by means of a control program stored in the ROM 306, and communicates with the finisher control unit 501.

In the finisher 1, a communications IC (IPC) unit (input unit) 510 is provided, and the finisher control unit 501 communicates with the main apparatus control unit 950 (CPU circuit section 305) via this communications IC unit 510.

The RAM 307 temporarily stores control data, and is used as an operation area for calculation accompanying controlling.

An ADF control section 301 controls the drive of an ADF 500 based on instructions from the CPU circuit section 305.

An image reader control section 302 controls the drive of the light source 907 and the lens system 908, and transfers analog image signals indicating R, G, and B images read by an image sensor, that is not shown, to an image signal control setion 303 through the lens system 908.

The image signal control section 303 converts the transferred R, G, and B analog image signals into digital signals and then applies various processings to these signals, and converts the processed digital signals into video signals and outputs them to a printer control section 304. The operation of the image signal control section 303 is controlled by the CPU circuit section 305.

The operating section 308 has a plurality of operating keys for setting various functions or operation modes relating to image formation and inputting information on the type of recording sheets and a display panel for displaying information on current setting conditions, and outputs signals responsive to operations of the operating keys to the CPU circuit section 305 and displays various information on the display panel based on signals from the CPU circuit section 305.

Furthermore, the CPU circuit section 305 transmits information showing the print mode (for example, a color print mode or a monochrome print mode) and information concerning the operation mode relating the sheet ejection pattern in the finisher 1 (for example, a non-sorting mode, a sorting mode, or a staple sorting mode) and the stapling mode (a one-point stapling mode or a two-point stapling mode) to the finisher control unit 501 via the communications interface units 960 and 510. Furthermore, the CPU circuit section 305 also transmits information showing the size and thickness (weight) of one of the recording sheets that is selected by the operation of the operating section 308 or detected by a sheet size sensor or a sheet thickness sensor to the finisher control unit 501.

To the CPU 401 of the finisher control unit 501, various actuators such as a gate motor Ml for driving the paired gate rollers 2, a buffer motor M2 for driving the buffer roller 5, and an ejecting motor M3 and various sensors such as the gate pass sensor 31, the pass sensors 32 and 33 are connected.

The main apparatus control unit 950 and the finisher control unit 501 may be integrally formed and provided in the main apparatus 300 (in this case, the operating section 308 is also an input unit).

Furthermore, the image forming apparatus is described in this embodiment in which the main apparatus 300 and the finisher 1 are separated from each other, however, the invention can be applied to image forming apparatuses (including not only a copying machine but also a printer and a facsimile, etc.) which has a sheet processing unit integrally formed. In this case, the operating part serves as an input unit to input information on the operating conditions of the sheet processing (operation modes relating to the print mode and the sheet ejection pattern, and the sheet type, etc.) into the control unit that is unified to administer control of the image forming part and the sheet processing part.

Furthermore, in a case where the image forming apparatus is used as a printer, information on operating conditions of sheet processing is inputted into the input unit from a host PC.

(Description of Flowcharts)

[Operation Mode Judgment Processing]

Figure 12:
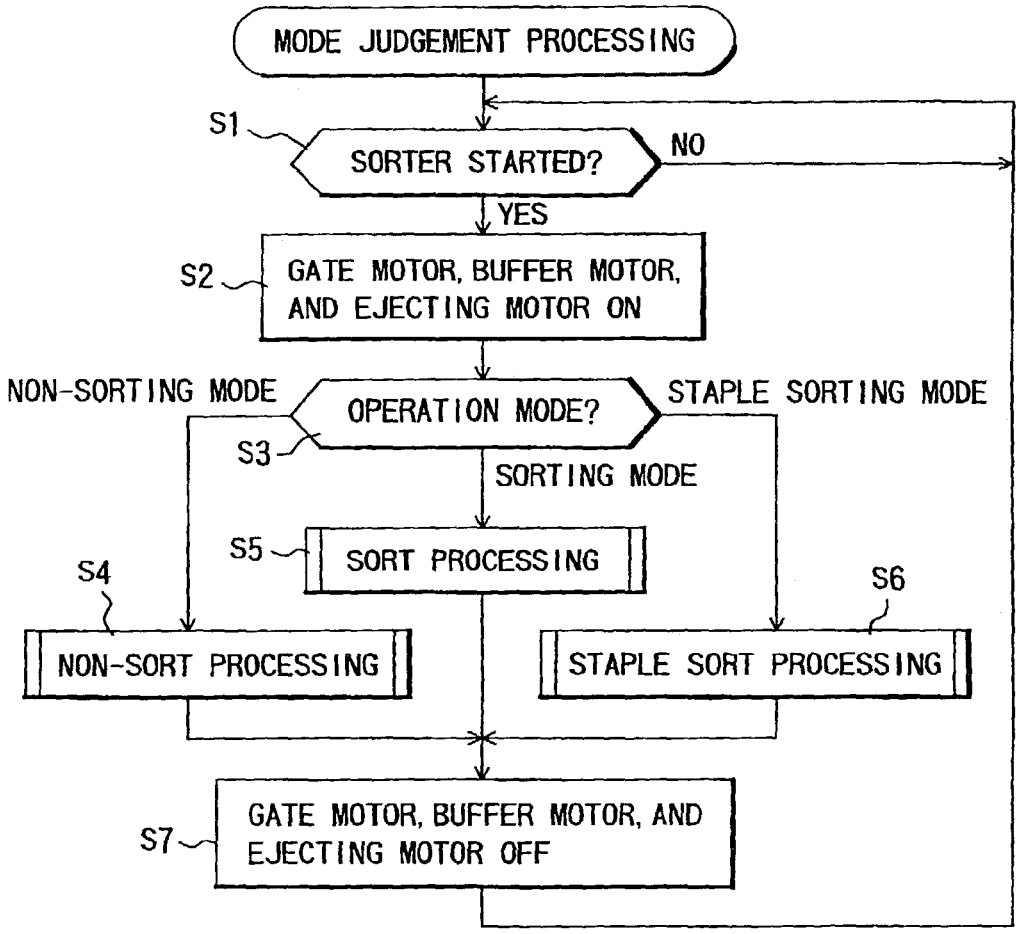
FIG. 12 is a flowchart for describing the operation of mode judgement processing in the sheet processing unit of FIG. 1.

FIG. 12 is a flowchart showing the procedures of the operation mode judgment processing. This operation mode judgment processing program is stored in the ROM 501*a* in the finisher control unit 501 and executed by the CPU 401.

First, the process waits for the finisher (sorter) to be turned ON to start (Step S1). When a start key for starting copying at the operating section 308 of the main apparatus 300 is pressed and a signal for starting the operation of the finisher 1 is inputted from the main apparatus 300 into the CPU 401 inside the finisher control unit 501 via the communications IC (IPC) unit 510, the finisher is turned ON to start.

Then, the CPU 401 starts driving the gate motor M1, the buffer motor M2, and the ejecting sheet motor M3 (Step S2). Herein, in a case where no signal for starting the operation of the finisher 1 is inputted into the CPU 401, the finisher 1 is in a standby state.

Next, the operation mode is judged (Step S3). This judgment is carried out based on the information showing the operation mode (the non-sorting mode, the sorting mode, or the staple sorting mode) transmitted from the main apparatus control unit 950 in response to the operation of the operating section 308. In a case where the operation mode is the non-sorting mode, non-sort processing is executed (Step S4). In a case where the operation mode is the sorting mode, sort processing is executed (Step S5). In a case where the operation mode is the staple sorting mode, staple sort processing is executed (Step S6).

Herein, in this embodiment, the non-sorting mode is a mode in which sheets are ejected onto the sample tray 201 without sorting, and the sorting mode is a mode in which sheets are ejected onto the stacking tray 200 while being sorted (being position-shifted for each sheet bundle). Furthermore, the staple sorting mode is a mode in which sheets are sorted by sheet staple processing and ejected onto the stacking tray 200.

When any processing of Steps S4 through S6 is finished, the drive of the gate motor M1, the buffer motor M2, and the ejecting motor M3 is stopped (Step S7), and the process returns to Step S1 and the finisher 1 returns to a standby state.

[Non-sort Processing]

Figure 13:
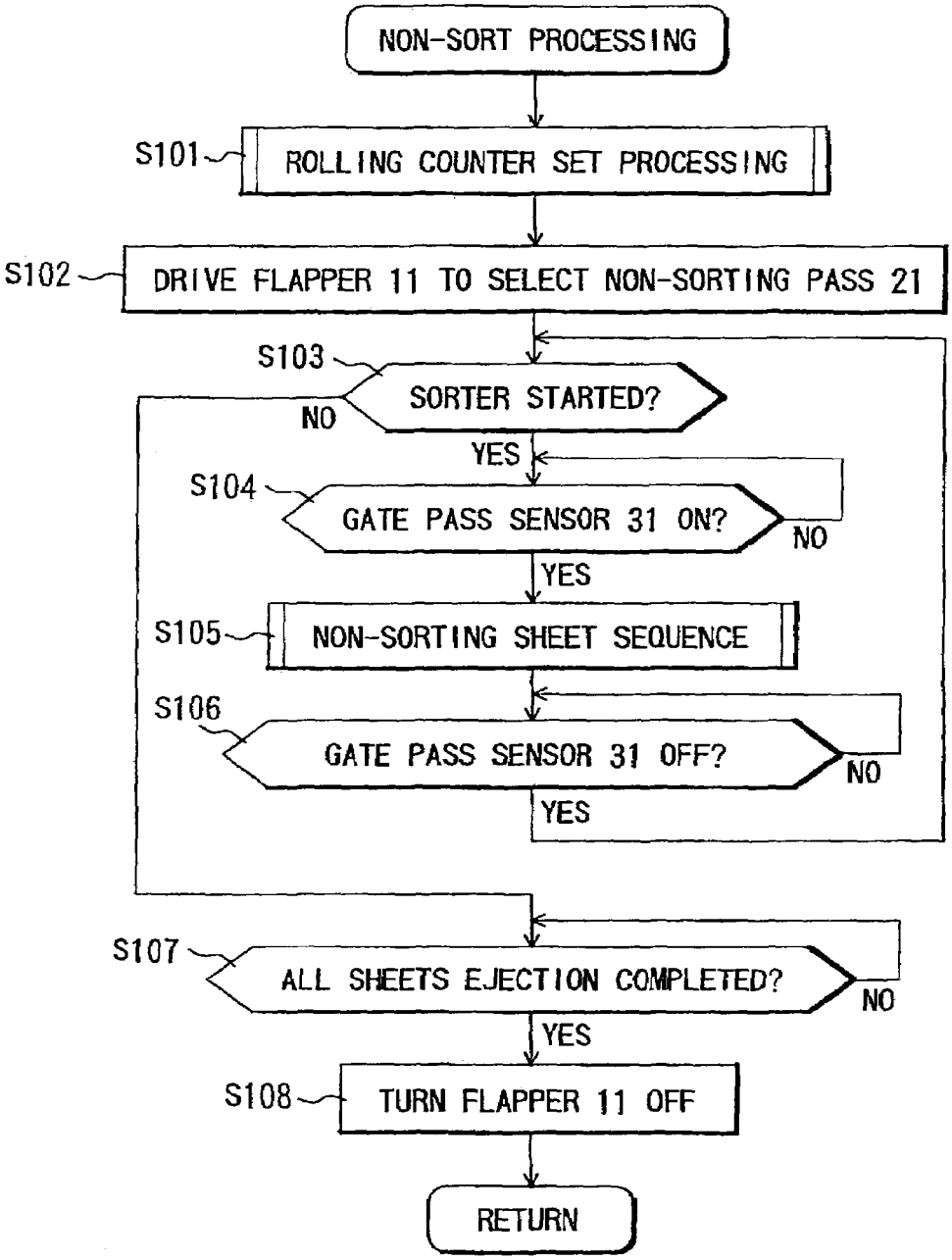
FIG. 13 is a flowchart for describing the operation of non-sort processing in the sheet processing unit of FIG. 1.

FIG. 13 is a flowchart showing the procedures of the non-sort processing. This non-sort processing is executed in Step S4 in a case where the operation mode has been judged as the non-sorting mode in Step S3.

In the non-sort processing, first, winding counter set processing described later is executed to set the number of sheets to be winded around the buffer roller 5 in accordance with the non-sort processing (this number plus one equals the number of sheets to be overlapped together on the buffer roller 5) (Step S101).

Herein, the purpose for setting the winding counter in accordance with the non-sort processing is to suppress failures in stacking sheets that are ejected without being subjected to alignment processing on the sample tray 201 by securing a length of time for statically stopping sheets by rolling sheets around the buffer roller 5 for each sheet ejected on the sample tray 201. The set winding counter value is decremented by one each time a sheet is winded around the buffer roller 5, and this decrement is continued until the counter value reaches zero.

Next, in order to guide the sheets P overlapped together on the buffer roller 5 to the sample tray 201, the switching flapper 11 (see FIG. 1 and FIG. 9) is driven to select the non-sorting pass 21 (Step S102).

As a result of judgement whether or not the finisher is ON and started (sorter start) (Step S103), when it is judged that the finisher is ON and started, a sheet ejected from the main apparatus 300 is delivered to the sheet pass inside the finisher 1. The delivered sheet is conveyed by the paired gate rollers 2 (see FIG. 1 and FIG. 9), and then, the process waits for the gate pass sensor 31 (see FIG. 1, FIG. 9, and FIG. 11) disposed inside the pass to be turned ON and detects the front end of the sheet (Step S104). When the gate pass sensor 31 is turned ON, the non-sorting sequence is started (S105).

Then, the process waits for the gate pass sensor 31 to be turned OFF after the rear end of the conveyed sheet passes over the gate pass sensor (Step S106).

When the gate pass sensor 31 is turned OFF, the process returns to the processing of Step S103, and in a case where the finisher is still ON and started, the same processing is repeated.

On the other hand, when the finisher is turned OFF, the process waits for all sheets to be ejected onto the sample tray 201 (Step S107), and when ejection of all sheets has been completed, the switching flapper 11 is de-actuated (Step S108), and the non-sort processing is ended.

[Sort Processing]

Figure 14:
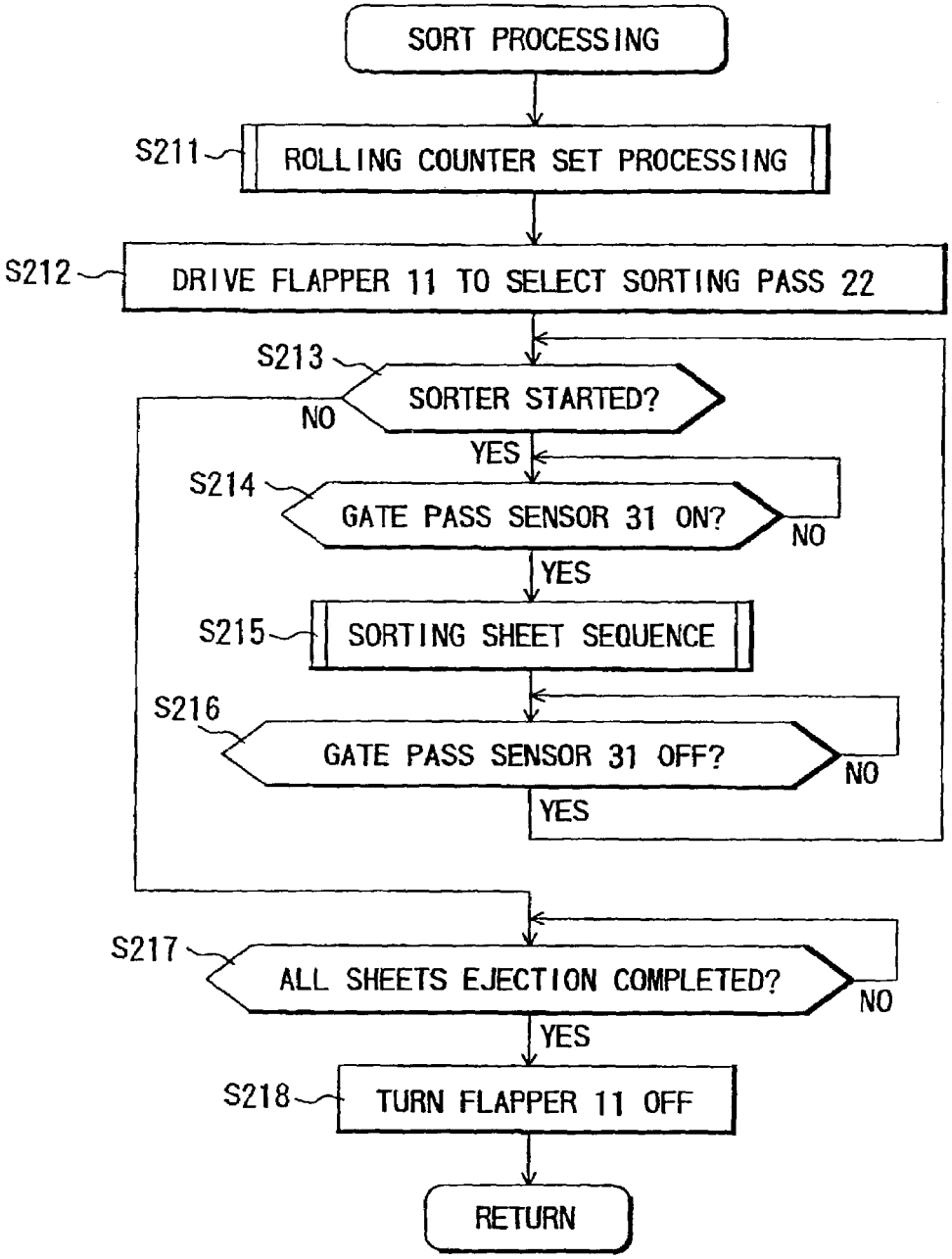
FIG. 14 is a flowchart for describing the operation of sort processing in the sheet processing unit of FIG. 1.

FIG. 14 is a flowchart showing the procedures of sort processing. This sort processing is executed in Step S5 in a case where the sorting mode has been judged in the abovementioned Step S3.

In the sort processing, in order to secure a sufficient sheet ejecting interval (time) onto the processing tray 130 so that sheets are ejected to and aligned at the processing tray 130 upon overlapping a sheet conveyed next with the sheet that has winded around the buffer roller 5, the winding counter set processing described later Is executed to set the number of sheets to be winded around the buffer roller 5 in accordance with the sorting mode (this number plus one equals the number of sheets to be overlapped together on the buffer roller 5) (S211).

Herein, the purpose for setting the counter value (resulting in, the number of sheets to be overlapped together on the buffer roller 5) in accordance with the sorting mode is to improve the yield of the main apparatus 300 (improvement in image forming rate) and improve the durability of the processing tray unit 129 including the aligning unit 140, etc., by reducing the number of aligning times and increasing the interval of conveying sheets to the processing tray unit 129 by rolling each of the sheets to be ejected onto the processing tray 130.

Next, the switching flapper 11 is driven to select the sorting pass 22 (Step S212).

Next, it is judged whether or not the finisher is ON and started (sorting start) (Step S213), and when the finisher has been turned ON, a sheet ejected from the main apparatus 300 is delivered to the sheet pass inside the finisher 1. The delivered sheet is conveyed by the paired gate rollers 2, and the process waits for the front end of the sheet to be detected by the gate pass sensor 31 disposed inside the pass (Step S214).

When the gate pass sensor 31 is turned ON, the sorting sheet sequence is started (Step S215). Then, the process waits for the gate pass sensor 31 to be turned OFF after the rear end of the conveyed sheet passes over the gate pass sensor 31 (Step S216).

When the gate pass sensor 31 is turned OFF, the process returns to the processing of Step S213, and in a case where the finisher is still ON and started, the same processing is repeated.

On the other hand, when the finisher is turned OFF, the process waits for all sheets to be ejected onto the processing tray 130 (Step S217), and when ejection of all sheets is completed, the switching flapper 11 is de-actuated (Step S218), and the sort processing is ended.

[Staple Sort Processing]

Figure 15:
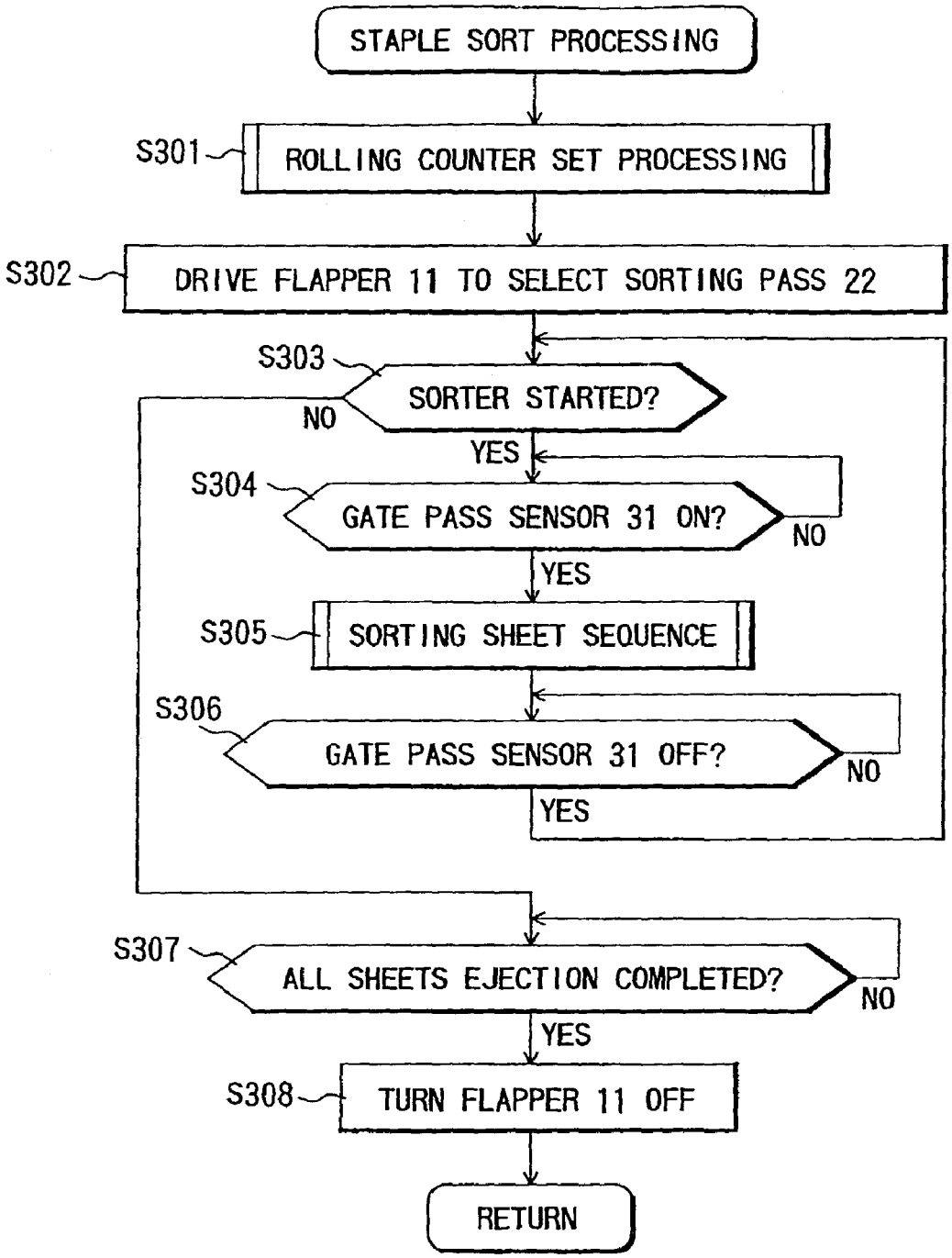
FIG. 15 is a flowchart for describing the operation of staple sort processing in the sheet processing unit of FIG. 1.

FIG. 15 is a flowchart showing the procedures of staple sort processing. This staple sort processing is executed in Step S6 when the operation mode is judged as the staple sorting mode in the abovementioned Step S3.

In the staple sort processing, in order to appropriate the period in which the next conveyed sheet is overlapped with a previous sheet that has winded around the buffer roller 5 for the sheet ejecting interval in which sheets are ejected onto the processing tray 130 (see FIG. 1 and FIG. 9), aligned and stapled, the winding counter set processing described later is executed to set the number of sheets to be winded around the buffer roller 5 in accordance with the staple sorting mode (this number plus one equals the number of sheets to be overlapped together on the buffer roller 5) (Step S301).

Herein, the purpose for setting the sheet winding counter in accordance with the staple sorting mode is to improve the yield (image forming rate) of the main apparatus 300 and improve the durability of the processing tray unit 129 including the aligning unit 140 and the stapling unit 100 by reducing the number of aligning and stapling times and increasing the interval of conveying the sheets to the sheet processing tray unit 129 by rolling each of the sheets to be ejected onto the processing tray 130.

Next, the switching flapper 11 is driven to select the sorting pass 22 (Step S302).

Successively, it is judged whether or not the finisher is ON and started (Step S303), and in a case where the finisher is ON and started, a sheet ejected from the main apparatus 300 is delivered to the sheet pass inside the finisher 1. The delivered sheet is conveyed by the paired gate rollers 2, and the process waits for the gate pass sensor 31 to be turned ON after the front end of the sheet is detected by the gate pass sensor 31 disposed inside the pass (Step S304). When the gate pass sensor 31 is turned ON, the sorting sheet sequence is started (Step S305).

The sheet is further conveyed, and the process waits for the gate pass sensor 31 to be turned OFF after the rear end of the sheet passes over the gate pass sensor 31 (Step S306). Then the pass sensor 31 is turned OFF, the process returns to Step S303, and when the finisher is still ON and started, the same processing is repeated.

On the other hand, when the finisher is OFF, the process waits for all sheets to be ejected onto the processing tray 130 (S307), and when ejection of all sheets is completed, the switching flapper 11 is de-actuated (Step S308) and the staple sort processing is ended.

[Non-sorting Sheet Sequence Processing]

Figure 16:
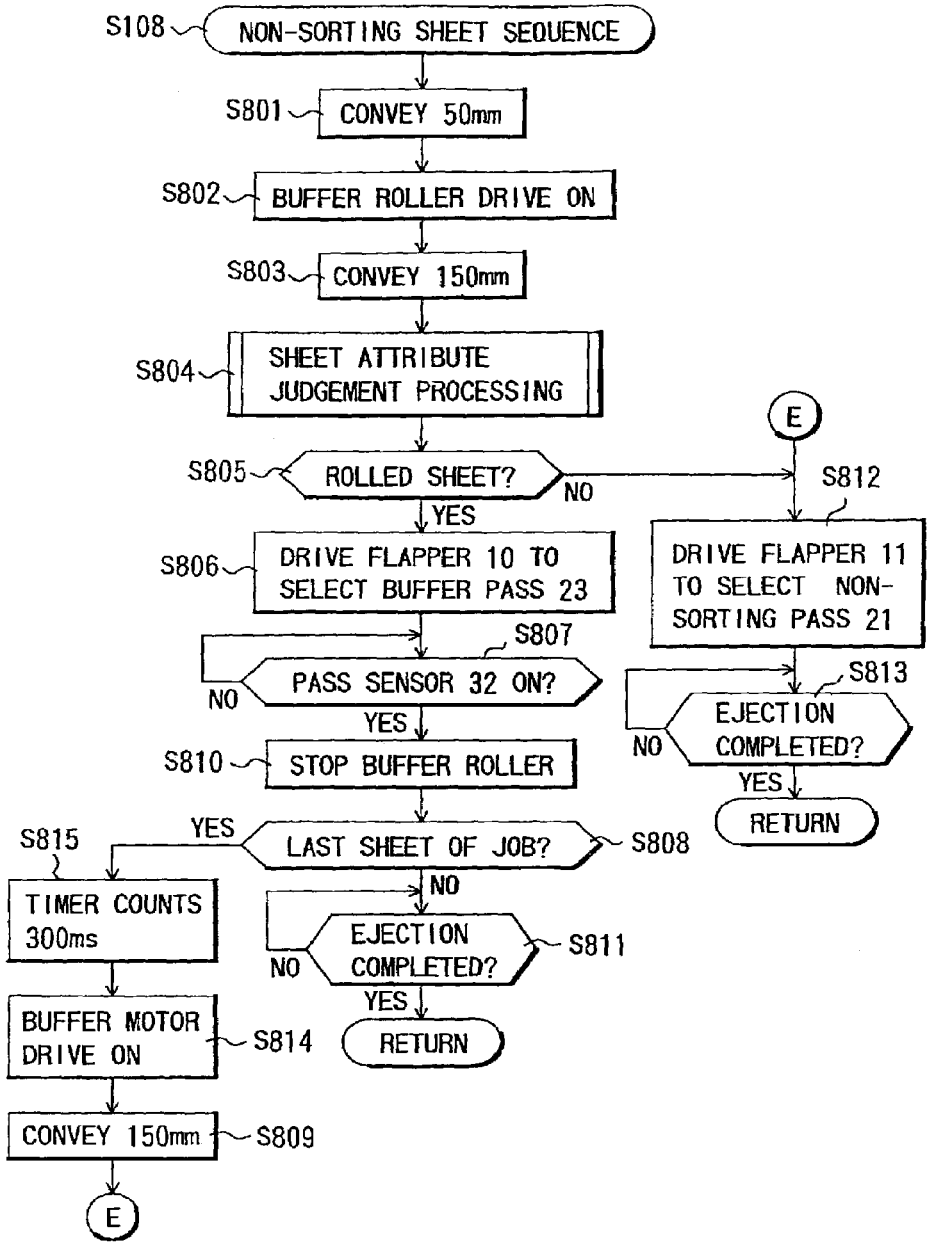
FIG. 16 is a flowchart for describing the operation of non-sorting sheet sequence processing in the sheet processing unit of FIG. 1.

FIG. 16 is a flowchart showing the procedures of non-sorting sheet sequence processing. This non-sorting sheet sequence processing is executed in the abovementioned non-sort processing of Step S105 and applied to each conveyed sheet. This processing program is processed by the CPU 401 by means of multitasking.

In the non-sorting sheet sequence processing, first, a sheet is conveyed for 50 mm (Step S801) and the buffer motor M2 (see FIG. 11) is started to drive the buffer roller 5 (see FIG. 1 and FIG. 9) (Step S802). Herein, since the non-sorting sheet sequence is started by turning the gate pass sensor 31 ON, the buffer motor 5 is started at a timing in which the front end of the sheet is conveyed for 50 mm to the downstream side from the position at which the gate pass sensor 31 was turned ON.

This start timing is for subsequent sheet conveyance, and in a case where a "winding sheet" that has rolled and stopped around the buffer roller 5 exists, the buffer roller 5 is restarted at this timing. By starting the buffer roller at this timing, it becomes possible to overlap the winding sheet that has already winded around the buffer roller 5 with a newly delivered sheet and convey them to the sample tray.

In this embodiment, as a condition for regulating this timing, the case of conveyance for 50 mm is indicated, however, this condition can be optionally set. Thereafter, the sheet is conveyed for 150 mm (Step S803) and then subjected to sheet attribute judgment processing (Step S804). Details of the sheet attribute judgment processing are described later, and for simple description herein, this processing is for judging whether the attribute of the sheet to be conveyed is "a sheet to be winded around the buffer roller 5 (winding sheet)" or "a sheet to be stacked into a bundle on the processing tray 130 and ejected in a bundle form (bundle-ejecting sheet)."

Next, on the basis of the sheet attribute judgment processing result, it is judged whether or not the newly delivered sheet is a winding sheet (Step S805), and when this sheet is specified as a winding sheet, the switching flapper 10 (see FIG. 1 and FIG. 9) is driven to select the buffer pass 23 (Step S806). By conveying the sheet in this condition, it becomes possible to guide the sheet to the buffer pass 23 and roll it around the buffer roller 5.

Then, when the pass sensor 32 on the buffer pass 23 is turned ON (Step S807), stopping control of the buffer motor M2 is started, and the sheet is winded around the buffer roller 5 (Step S810). When the front end of the sheet passes over the pass sensor 32, the buffer roller 5 is stopped, and at this point, in a case where rolling control is carried out, the buffer roller 5 is stopped in consideration of an amount of overrun.

After the buffer roller 5 is stopped, it is judged whether or not the sheet is the last sheet of the job (Step S808), and when it is judged that the sheet is not the last sheet of the job, the sheet winded around the buffer roller 5 remains in a standby state as it is winded around the buffer roller 5 until a subsequent sheet is delivered into the finisher 1 and the buffer roller 5 is restarted. Then, after the buffer roller 5 is restarted, at a timing in which ejection onto the sample tray 201 is completed, the processing is ended (Step S811).

On the other hand, in a case where the sheet is judged as the last sheet of the job in Step S808, after interruption at 300 ms (Step S815), the buffer roller 5 is started (Step S814). Thereafter, the sheet is conveyed for 150 mm (Step S809) and the switching flapper 11 is driven to select the non-sorting pass 21 (Step S812). Then, at a timing in which sheet ejection onto the sample tray 201 is completed, the processing is ended (Step S813).

On the other hand, in a case where it is judged that the sheet is not a winding sheet in Step S805, the switching flapper 11 is driven to select the non-sorting pass 21 (Step S812). Then, at a timing in which sheet ejection onto the sample tray 201 is completed, the processing is ended (Step S813).

In the case where two sheets are overlapped together on the buffer roller 5 each time before being ejected to the sample tray 201, when one copy of a document including an odd number of sheets or an odd number of copies of a document including one sheet are made, the last sheet cannot be overlapped with another sheet, so that a processing time for a sheet previous to the last sheet cannot be secured, however, in the case where the last sheet is specified as a winding sheet as in this embodiment, even when no sheet to be overlapped with the last sheet exists, the last sheet is ejected after it is winded around the buffer roller 5 and the buffer roller 5 is temporarily stopped, whereby a constant processing time can be always obtained.

In this embodiment, the period of stopping the last sheet is set to 300 ms, however, the period is not limited to 300 ms, and it is only required that the last sheet is stopped only for a period required for processing the sheet previous to the last sheet, and as long as there is sufficient time for processing the last sheet is allowed to only pass through the buffer pass 23 without stopping.

Furthermore, in this embodiment, the pass for retaining sheets (buffer pass 23) and the normal pass (non-sorting pass 33) do not exist in the same pass, however, even when the pass for retaining sheets and the normal pass exist in the same pass, the same control as in the description of this embodiment is possible.

[Sorting Sheet Sequence Processing]

Figure 17:
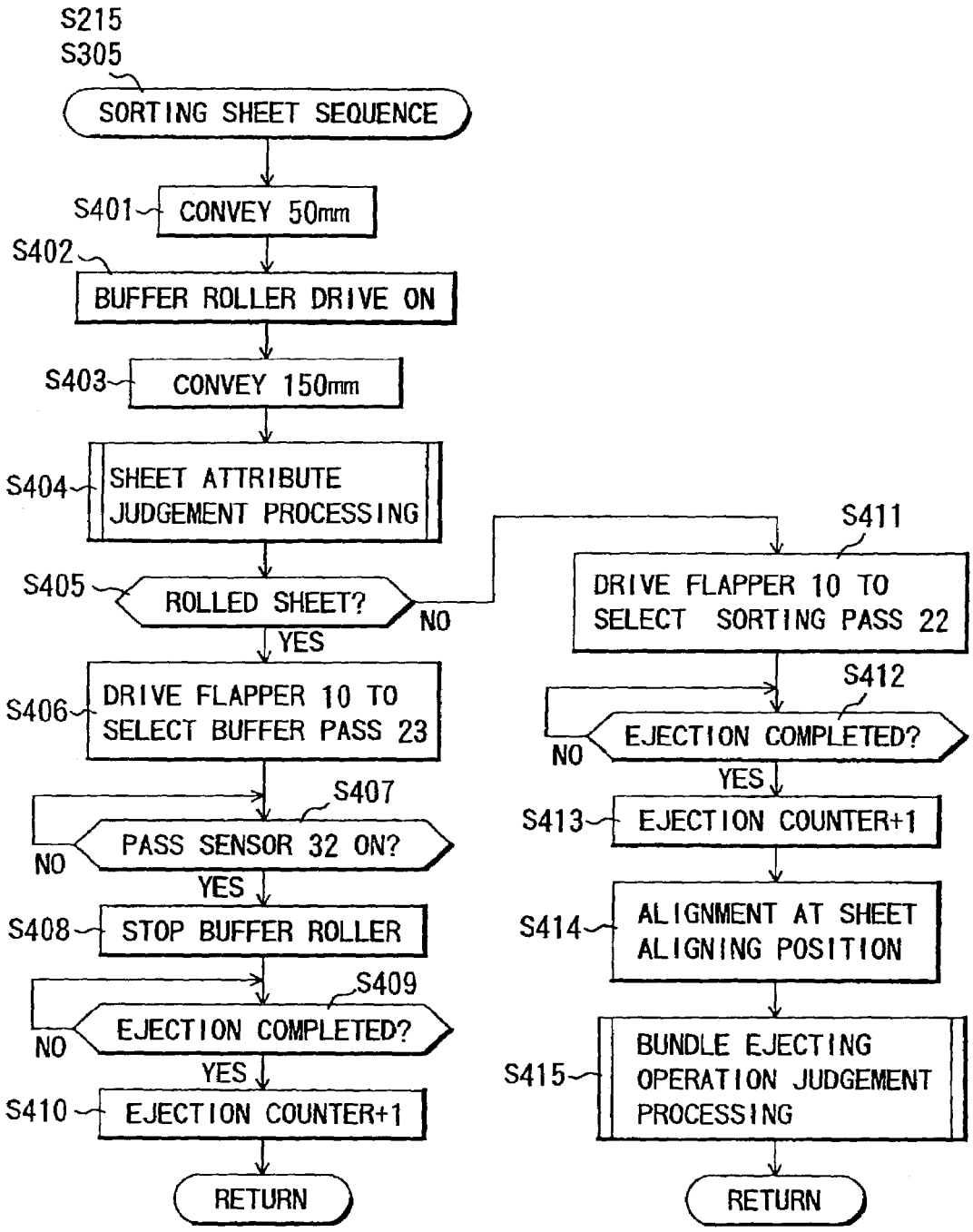
FIG. 17 is a flowchart for describing the operation of sorting sheet sequence processing in the sheet processing unit of FIG. 1.

FIG. 17 is a flowchart showing the procedures of the sorting sheet sequence processing. This sorting sheet sequence processing is executed in Step S215 of the sort processing described in FIG. 14 and Step S305 of the staple sort processing described in FIG. 15 for each sheet to be conveyed. Furthermore, this processing program is processed by the CPU 401 by means of multitasking.

In the sorting sheet sequence processing, a sheet is conveyed for 50 mm first (Step S401), and the buffer motor M2 is started to drive the buffer roller 5 (Step S402). Herein, the sorting sheet sequence is started by turning the gate pass sensor 31 ON, the buffer roller 5 is started at a timing in which the front end of the sheet is conveyed for 50 mm to the downstream side from the position at which the gate pass sensor 31 is turned ON.

This start timing is for subsequent sheet conveyance, and in a case where a "winding sheet" that has winded around and stopped at the buffer roller 5 exists, the buffer roller 5 is restarted at this timing. By restarting at this timing, it becomes possible to overlap the sheet that has winded around the buffer roller 5 with the newly delivered sheet and convey them to the processing tray 130.

In this embodiment, as a condition for regulating this timing, the case where this timing is at the conveying distance of 50 mm is described, however, this condition can be optionally set. After this timing, the sheet is conveyed for 150 mm (Step S403) and the sheet attribute judgment processing is executed (Step S404). This sheet attribute judgment processing is as mentioned above.

Next, based on the result of the sheet attribute judgment processing, it is judged whether or not the newly delivered sheet is a winding sheet (Step S405), and when this sheet is specified as a winding sheet, the switching flapper 10 is driven to select the buffer pass 23 (Step S406). By conveying the sheet in this condition, it becomes possible to guide the sheet to the buffer pass 23 and roll it around the buffer roller 5.

Then, stopping control of the buffer motor M2 is started at a timing in which the pass sensor 32 on the buffer pass 23 is turned ON, and the sheet Is winded around the buffer roller 5 (Steps S407 and S408). When the front end of the sheet passes over the pass sensor 32, the buffer roller 5 is stopped, and at this point, in a case where winding control is carried out, the buffer roller 5 is stopped in consideration of an amount of overrun.

After the buffer roller 5 is stopped, the winding sheet remains in a standby state as it is winded around the buffer roller 5 until a subsequent sheet is delivered into the finisher 1 and the buffer roller 5 is restarted. In a case where the subsequent sheet is judged as a winding sheet, the above-mentioned operation is repeated.

Then, after the buffer roller 5 is restarted in response to delivery of a subsequent sheet that is judged as the last sheet, at a timing in which ejection onto the processing tray 130 is completed (Step S409), the ejection counter value indicating the number of sheets which have been ejected onto the processing tray 130 is incremented by one and the processing is ended (Step S410).

On the other hand, in a case where it is judged that the sheet is not a winding sheet in Step S405, the switching flapper 10 is driven to select the sorting pass 22 (Step S411). By selecting the sorting pass 22, the sheet is guided not to the buffer pass 23 but to the sorting pass 22 that is a path of ejection onto the processing tray 130.

Then, after completion of sheet ejection onto the processing tray 130 is confirmed (Step S412), the ejection counter value is incremented by one (Step S413), and alignment is carried out at an aligning position that is set for each sheet by using the two aligning members 141 and 142 (see FIG. 5 and FIG. 6) of the aligning unit 140. During this ejecting operation onto the processing tray 130, at the same time as sheet ejection, an operation of sheet alignment in the direction (front and rear direction) orthogonal to the sheet conveying direction is carried out, and sheet alignment in the sheet conveying direction is carried out by rotating the draw-in paddle 160.

Thereafter, the bundle ejecting operation judgment processing (Step S415) described later is carried out, and the processing is ended.

[Sheet Attribute Judgment Processing]

Figure 19:
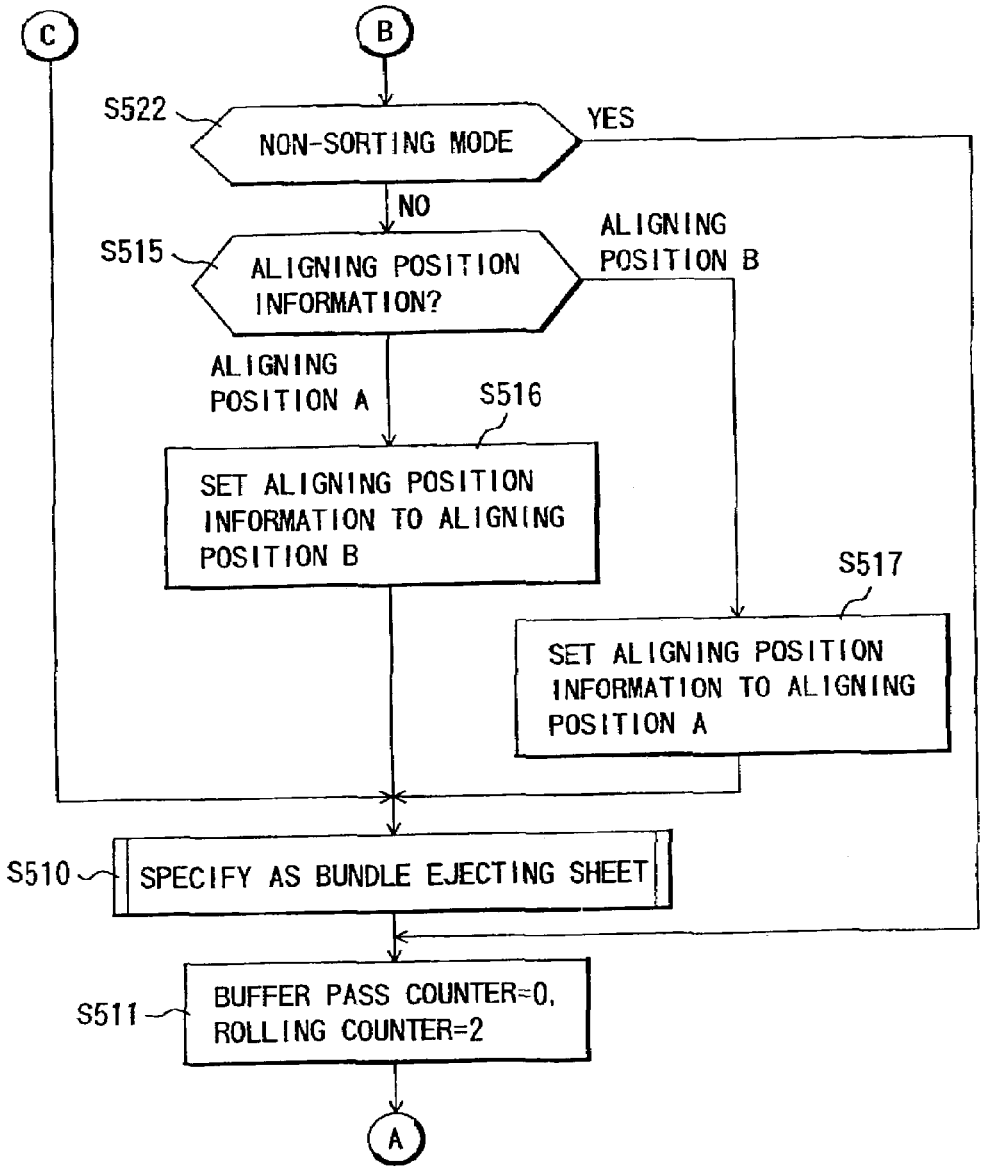
FIG. 19 is a flowchart for describing the operation of sheet attribute judgment processing in the sheet processing of FIG. 1.

FIG. 18 and FIG. 19 are flowcharts showing the procedures of sheet attribute judgment processing. This sheet attribute judgment processing is executed in Step S404 of the abovementioned sorting sheet sequence processing and Step S804 of the non-sorting sheet sequence processing. In FIG. 18 and FIG. 19, parts indicated by the same circled alphabetic letters are linked to each other.

First, the buffer pass counter value indicating the number of sheets that have passed through the buffer roller 5 (see FIG. 1 and FIG. 9) is incremented by one each time one sheet passes through the buffer roller 5 (Step S501). Then, it is determined which of the front side or the rear side a sheet is aligned and positioned at for bundle sorting when the sheet is ejected onto the processing tray 130, and this determination is set as sheet-by-sheet information (aligning position information) (Step S502).

Subsequently, it is judged whether or not the sheet that has newly passed through the buffer roller 5 is the last sheet of one bundle (Step S503). Therein, one bundle is a unit of sorting in the case of the sorting mode, and is a unit of stapling in the case of the staple sorting mode, and is a unit of one job in the case of the non-sorting mode.

When it is judged that the sheet is not the last sheet of one bundle, it is judged whether or not this sheet has a size (length) which enables the sheet to roll around the buffer roller 5 (Step S504).

In the case where the sheet has a size which enables the sheet to roll, it is judged whether or not this sheet is two sheets before the last sheet of one bundle (Step S505). When the sheet is judged to be two sheets before the last sheet of one bundle, it is judged whether or not the value of the winding counter is 2 by referring to the winding counter indicating the number of sheets to be winded around the buffer roller 5 (Step S506).

In a case where the winding counter value is 2, the winding counter value is decremented by one (Step S518) and the sheet is specified as a "winding sheet" (Step S512).

On the other hand, when it is judged in Step S505 that the winding counter value is not 2, winding counter set processing is executed to set a number of sheets to be winded around the buffer roller 5 corresponding to the operation mode (this number plus one equals the number of sheets to be overlapped together on the buffer roller 5) (Step S520).

Next, it is judged whether or not the operation mode is the sorting mode (Step S513). When the operation mode is not the sorting mode, the processing is ended. On the other hand, when the operation mode is the sorting mode, it is judged whether or not the buffer pass counter value is 5 or more (Step S514).

When the buffer pass counter value is 5 or more, the sheet is specified as a "bundle ejecting sheet" meaning that the sheet is to be ejected in a bundle from the processing tray 130 (Step S510), and the buffer pass counter value is set to 0 and the winding counter value is set to 2 (Step S511). In a case other than these, the processing is ended as it is.

On the other hand, when it is judged in Step S506 that the sheet is not two sheets before the last sheet of one bundle, it is judged whether or not the winding counter value is 0 (Step S508).

When the winding counter value is not 0, the winding counter value is decremented by one (Step S518), and the sheet is specified as a "winding sheet" (Step S512).

On the other hand, when it is judged in Step S508 that the winding counter value is 0, the winding counter set processing is executed (Step S520).

Next, it is judged whether or not the operation mode is the sorting mode (Step S513). When the operation mode is not the sorting mode, the processing is ended.

On the other hand, when the operation is judged as the sorting mode, it is judged whether or not the buffer pass counter value is 5 or more (Step S514). When it is judged that the buffer pass counter value is 5 or more, the sheet is specified as a "bundle ejecting sheet" meaning that the sheet is to be ejected in a bundle from the processing tray 130 (Step S510), and the buffer pass counter value is set to 0 and the winding counter value is set to 2 (Step S511). In a case other than these, the processing is ended as it is.

On the other hand, when it is judged in Step S504 that the sheet does not have a size that enables winding, it is judged whether or not the operation mode is the sorting mode (Step S507).

When the operation mode is not the sorting mode, the processing is ended. When the operation mode is the sorting mode, it is judged whether or not the buffer pass counter value is 3 (Step S509). When the buffer pass counter value is not 3, the processing is ended, and when the value is 3, the processing of the abovementioned Step S510 is executed.

The processings of the abovementioned Steps S510 and S511 are, respectively, processing for specifying the conveyed sheet as a "bundle ejecting sheet" meaning that the sheet is to be ejected in a bundle (S510) and processing for setting the counters (clearing the buffer pass counter and setting the winding counter: S511).

Herein, specification as a "bundle ejecting sheet" means that an operation of bundle ejection from the processing tray 130 to the stacking tray 200 is started when the conveyed sheet is judged as the last sheet of one bundle and ejected to and stacked on the processing tray 130, and this specification is used in bundle ejecting operation judgment processing described later.

On the other hand, when the conveyed sheet is judged as the last sheet of one bundle in Step S503, it is judged whether or not the operation mode is the non-sorting mode (Step S522). When the operation mode is the non-sorting mode, the buffer pass counter value is set to 0 and the winding counter value is set to 2 (Step S511), and processing is ended.

On the other hand, when the operation mode is not the non-sorting mode, information opposite to the currently set aligning position information is set by the following steps. The aligning position information is set sheet by sheet, and herein, the front side is regarded as an aligning position A and the rear side is regarded as an aligning position B.

First, currently set aligning position information is judged (Step S515), and when the judged aligning position information shows the aligning position A, the aligning position B is set as the aligning position information (Step S516). When the judged aligning position information shows the aligning position B, the aligning position A is set as the aligning position information (Step S517).

By thus inverting the aligning position information, sorting for offsetting each bundle front or rearward on the processing tray or stacking tray 200 becomes possible. Thereafter, the process transfers to the processing of Step S510.

By the abovementioned processing, the sheet attribute (a winding sheet/a bundle ejecting sheet) judgment and set processing is completed.

[Bundle Ejecting Operation Judgment Processing]

Figure 20:
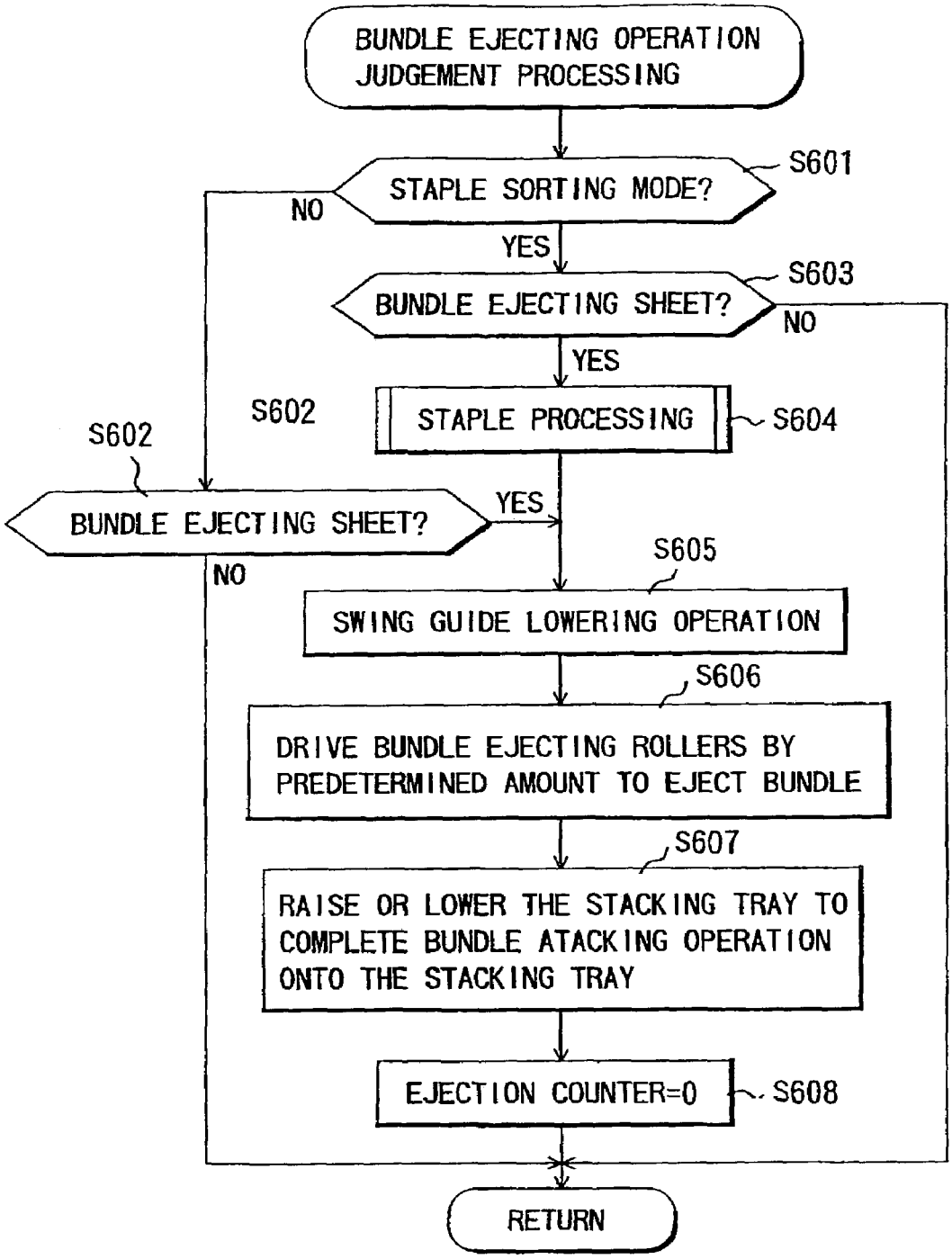
FIG. 20 is a flowchart for describing the operation of bundle ejecting operation judgment processing in the sheet processing unit of FIG. 1.

FIG. 20 is a flowchart showing the procedures of bundle ejecting operation judgment processing. This bundle ejecting operation judgment processing is executed in Step S415 in the abovementioned sorting sheet sequence processing.

In the bundle ejecting operation judgment processing, first, it is judged whether or not the operation mode is the staple sorting mode (Step S601). When it is judged that the operation mode is not the staple sorting mode, it is judged whether or not the sheets ejected onto the processing tray 130 are bundle ejecting sheets (Step S602). When it is judged that the sheets are not bundle ejecting sheets, the processing is ended, and the process returns to the abovementioned sorting sheet sequence processing.

On the other hand, when the sheets ejected onto the processing tray 130 are judged as bundle ejecting sheets in Step S602, a sheet bundle on the processing tray 130 is aligned, and then the swing guide 150 is lowered to the closed position and the bundle ejecting upper roller **180*b* is made to contact with the sheet bundle on the processing tray 130 (Step S605). Thereafter, the process waits for the bundle ejecting upper roller 180*b* to stop bounce, and the paired bundle ejecting rollers 180 are driven by a predetermined amount, and the sheet bundle on the processing tray 130 is ejected onto the stacking tray 200 while controlling the speed of the bundle ejecting motor M180 (Step S606**).

Then, the stacking tray 200 is raised or lowered to complete the bundle stacking operation onto the stacking tray 200 (Step S607). Thereafter, the ejection counter value is set to 0 (Step S608), and the processing is completed.

On the other hand, when it is judged that the operation mode is the staple sorting mode in Step S601, it is judged whether or not the sheets ejected onto the processing tray 130 are bundle ejecting sheets (Step S603). When it is judged that the sheets are not bundle ejecting sheets, the processing is ended, and the process returns to the abovementioned sorting sheet sequence processing.

On the other hand, when it is judged that the sheets ejected onto the processing tray 130 are bundle ejecting sheets, the process transfers to the staple processing sequence (Step S604). Namely, after a sheet bundle on the processing tray 130 is aligned and stapled (S604).

Thereafter, the process transfers to Step S605, the swing guide 150 is lowered to the closed position, and the abovementioned bundle ejecting operation is carried out (Steps S606 through S608). Thereafter, the processing is ended, and the process returns to the sorting sheet sequence.

[Staple Processing]

Figure 21:
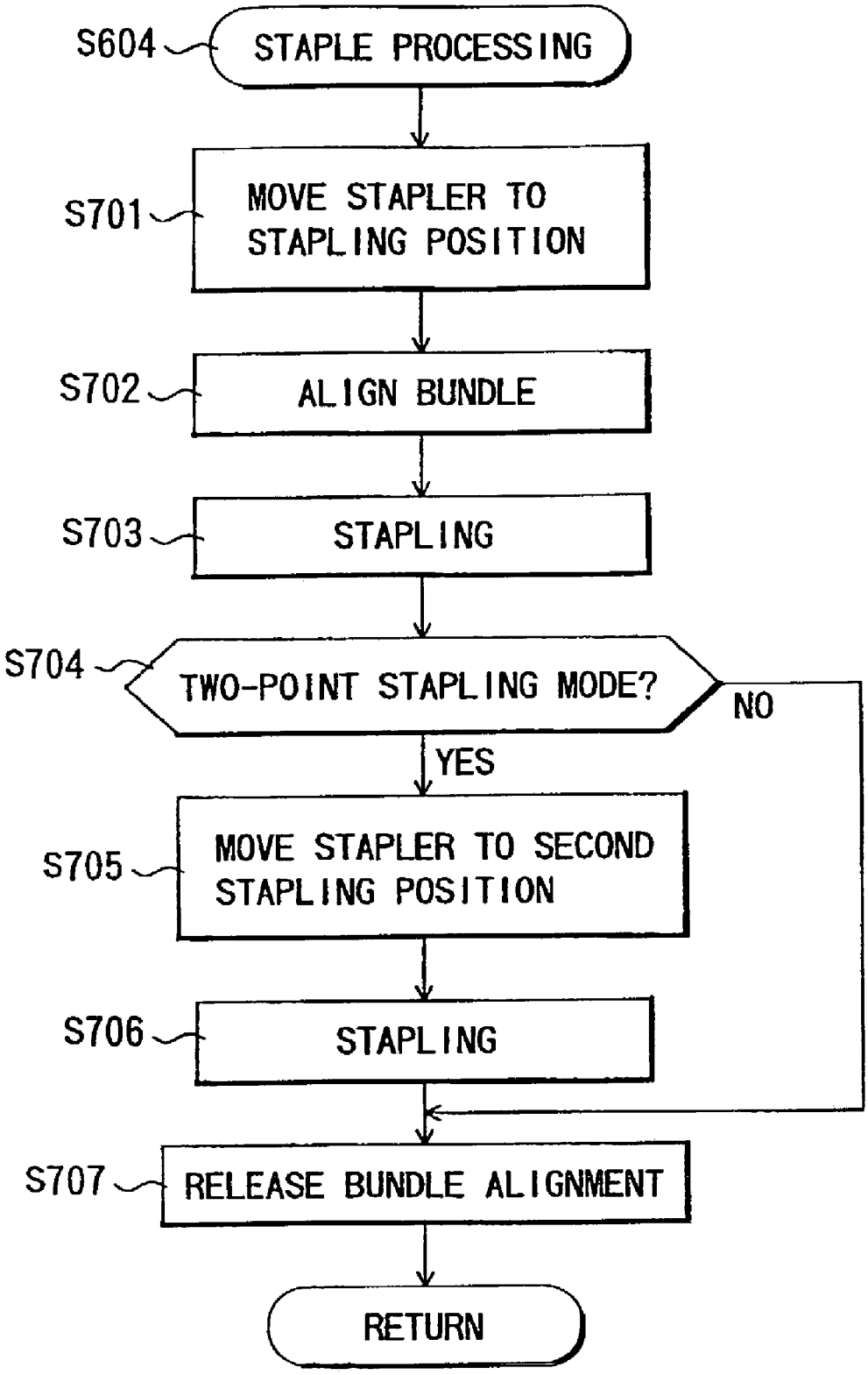
FIG. 21 is a flowchart for describing the operation of staple processing in the sheet processing unit of FIG. 1.

FIG. 21 is a flowchart showing the procedures of staple processing. This staple processing is executed in Step S604 of the abovementioned bundle ejecting operation judgment processing.

In the staple processing, first, the stapler 101 is moved to the front stapling position corresponding to the sheet width (Step S701). Furthermore, the sheet bundle on the processing tray 130 is aligned by the aligning unit 140 that has the front aligning member 141 and the rear aligning member 142 (Step S702), and thereafter, stapling operation is carried out (Step S703).

Then, based on information showing the stapling mode transmitted from the main apparatus control unit 950 in response to operation at the operating section 308, it is judged whether or not the stapling mode is the two-point stapling mode (Step S704), and when the mode is not the two-point stapling mode (that is, the mode is the one-point stapling mode), bundle alignment by the aligning unit 140 is canceled (Step S707) and staple processing is ended.

On the other hand, when it is judged that the mode is the two-point stapling mode in Step S704, the stapler 101 is moved to the rear stapling position corresponding to the sheet width (Step S705) and a stapling operation for the second point is carried out (Step S706), sheet bundle alignment by the aligning unit 140 is canceled (Step S707), and staple processing is ended.

[Description of Operation of Rolling Sheets Around the Buffer Roller 5]

Figure 22:
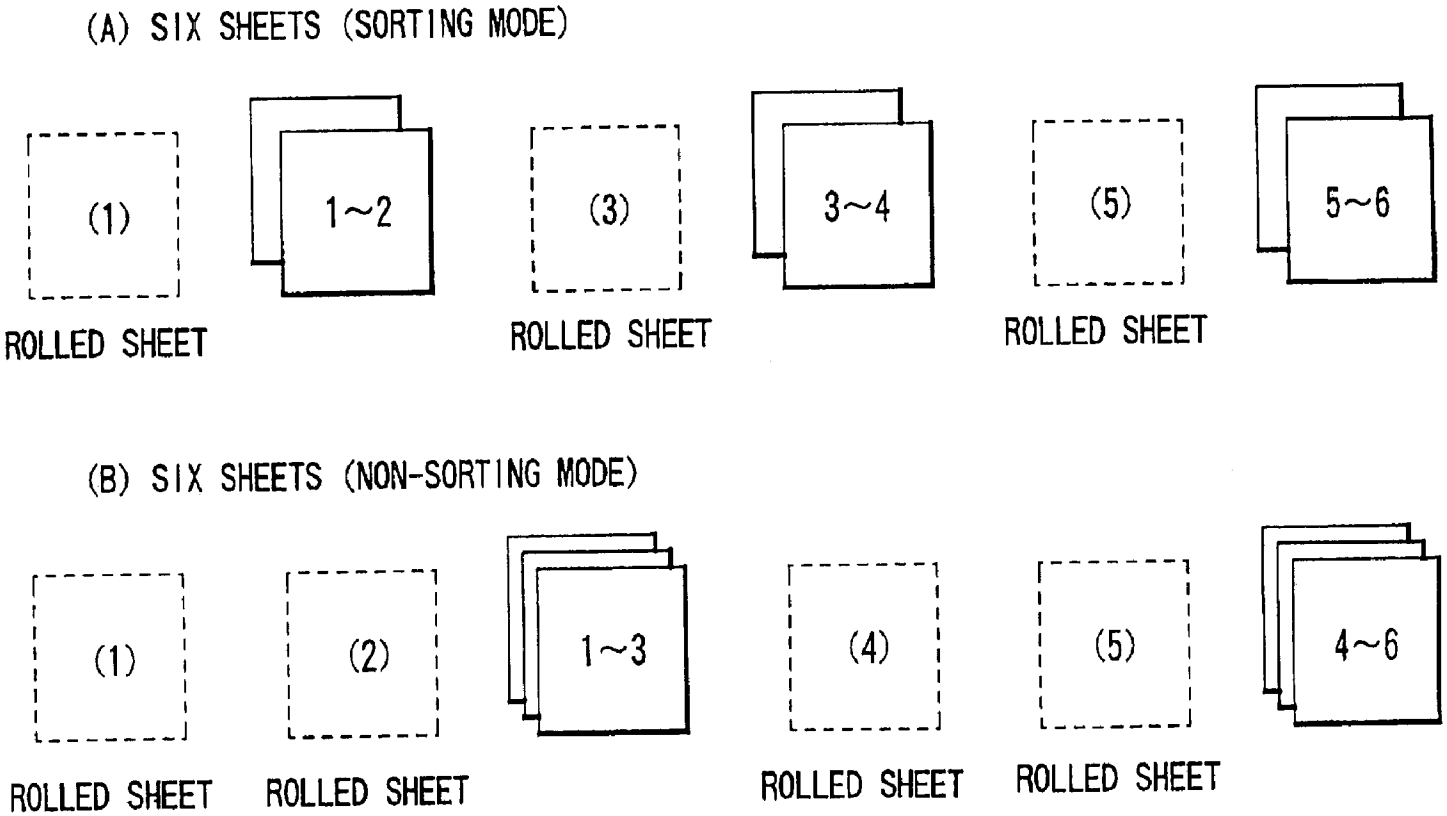
FIGS. 22 are drawings showing detailed examples of rolling operation in the sheet processing unit of FIG. 1.

Next, a detailed example of an operation of rolling sheets around the buffer roller 5 (operation of conveying sheets to the sample tray 201 or the processing tray 130 after overlapping the sheets together) is described based on the sheet attribute judgment processing of FIG. 18 and FIG. 19. FIGS. 22 show detailed examples of the rolling operation.

FIG. 22(B) shows a case where a document including a total of six sheets is processed in the non-sorting mode. In the non-sorting mode, for the first sheet, the winding counter value is set to 2 (Step S101), and the first sheet is specified as a winding sheet (Step S512). Thereby, the first sheet is winded around the buffer roller 5.

Likewise, the second sheet is also specified as a winding sheet (Step S512), and winded around the buffer roller 5 by being overlapped with the first sheet. The third subsequent sheet is overlapped with the first sheet and second sheet that have been winded around the buffer roller 5, and these three sheets are ejected onto the sample tray 201 together.

The subsequent fourth sheet is specified as a winding sheet (Step S512), and winded around the buffer roller 5. Likewise, the fifth sheet is also specified as a winding sheet (Step S512), and winded around the buffer roller 5 by being overlapped with the fourth sheet. The next sixth sheet is overlapped with the fourth and fifth sheets that have been winded around the buffer roller 5, and these three sheets are ejected onto the sample tray 201 together.

FIG. 22(A) shows a case where a document including a total of six sheets is processed in the sorting mode. In the sorting mode, the winding counter value is set to 1 for the first sheet (Step S211).

Herein, a reason why a larger winding counter value (the number of sheets to be winded around the buffer roller 5) is set in the non-sorting mode rather than in the sorting mode is that the sheet conveying speed is lower and left as is, the sheet conveying interval becomes shorter (narrower) in the non-sorting mode than in the sorting mode due to the reasons described below, so that it is required that the sheet conveying interval is longer (wider) in the non-sorting mode than in the sorting mode.

Furthermore, in FIG. 22(B), the case where the number of sheets to be overlapped together in the non-sorting mode is set to 3 is described, however, the number is not limited to 3, and can be set to any number as long as the number is larger than in the sorting mode and can be ejected together.

The first sheet is specified as a winding sheet and winded around the buffer roller 5. The second sheet is overlapped with the first sheet that has been winded around the buffer roller 5, and these two sheets are ejected onto the processing tray 130 together. The subsequent third and fourth sheets and the fifth and sixth sheets are overlapped one with another, and ejected onto the processing tray 130.

Herein, the number of sheets to be overlapped together in the sorting mode is set to 2, however, the number is not limited to 2, and can be set to any number as long as the number is smaller than in the non-sorting mode and can be ejected together.

[Winding Counter Set Processing]

Figure 23:
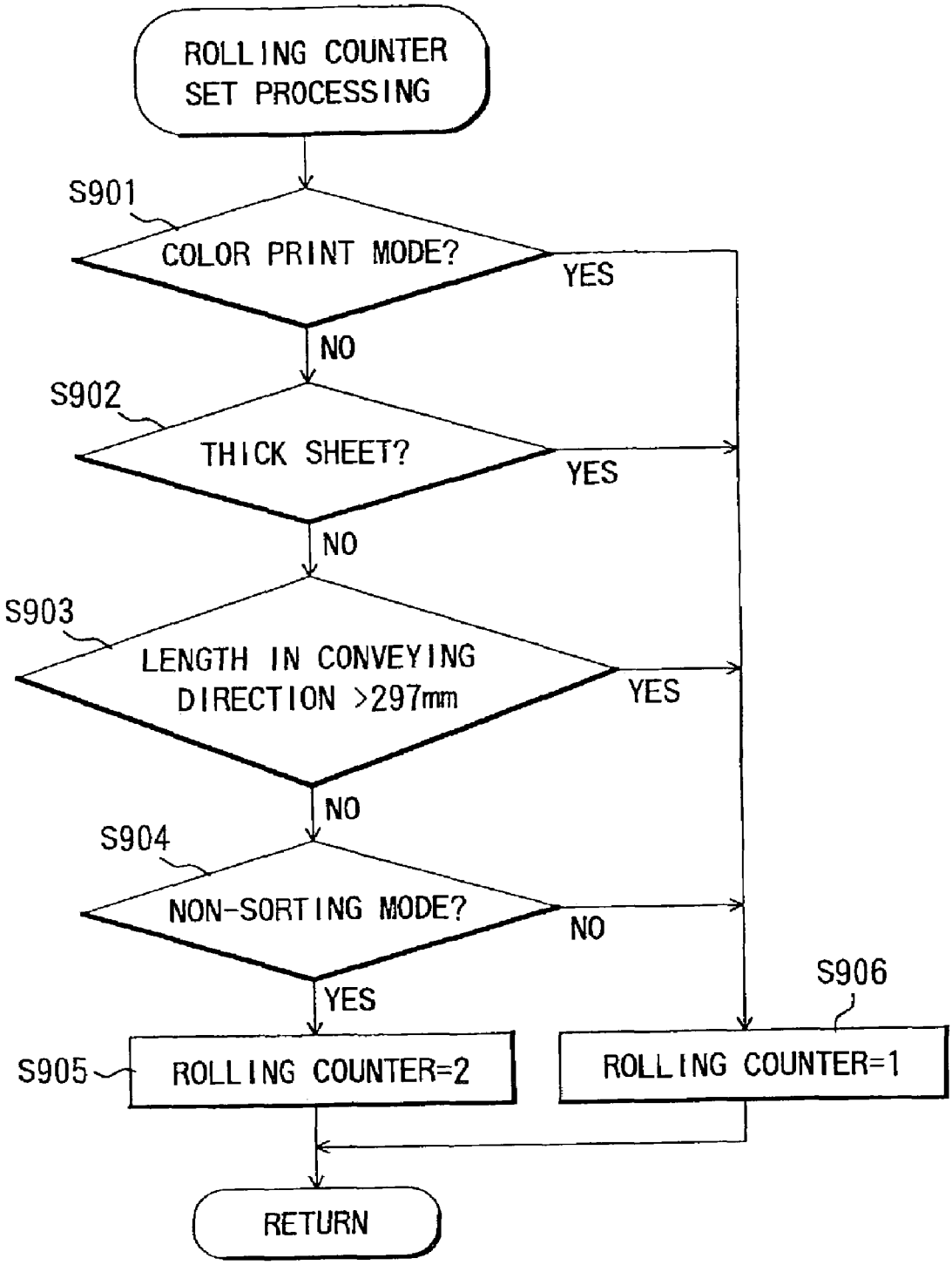
FIG. 23 is a flowchart for describing winding counter set processing in the sheet processing unit of FIG. 1.

FIG. 23 is a flowchart showing the procedures of winding counter set processing. This winding counter set processing is executed in Step S520 of the abovementioned sheet attribute judgment processing, S101 of the non-sort processing, Step S211 of the sort processing, and S301 of the staple processing.

In the winding counter set processing, first, based on information showing a print mode inputted from the main apparatus control unit 950 in response to operation at the operating section 308, it is judged whether the mode is a color print mode or a monochrome print mode (that is, whether the sheet type is a color print sheet or a monochrome print sheet) (Step S901). When it is judged that the mode is the color print mode, the winding counter value is set to 1 (Step S609) and the winding counter set processing is ended.

Herein, a reason why the winding counter value in the color print mode is set to 1 that is smaller than the settable number of 2 in Step S905 described later is that the print speed of the main apparatus 300 is lower in the color print mode than in the monochrome print mode, and this allows sufficient time for processing. Furthermore, color printed sheets are lower in coefficient of friction of sheet surfaces than monochrome printed sheets and easily become out of alignment, so that the number of color printed sheets allowed to roll around the buffer roller 5 must be smaller than that of monochrome printed sheets.

In Step S901, in a case where the mode is the monochrome print mode, based on information showing the sheet weight (or thick sheets/normal sheets) inputted from the main apparatus control unit 950 in response to operation at the operating section 308, it is judged whether or not sheets to be conveyed are thick sheets (that is, whether or not sheets to be conveyed have a predetermined weight) (Step S902). In the case where the sheets are judged as thick sheets (herein, sheets with 105 g or more are thick sheets), the winding counter value is set to 1 (Step S906), and the winding counter set processing is ended.

Herein, a reason why the winding counter is set to the smaller number of 1 in the case of thick sheets is that the number of thick sheets allowed to roll around the buffer roller 5 is smaller than that of normal sheets since the rigidity of thick sheets is greater than that of normal sheets.

When it is judged that the sheets are not thick sheets in Step S902, based on information showing a sheet size inputted from the main apparatus control unit 950 in response to operation at the operating section 308, it is judged whether or not the length in the conveying direction of sheets to be conveyed is longer than 297 mm (Step S903). When it is judged that the sheet length is longer than 297 mm, the winding counter value is set to 1 (Step S906) and the winding counter set processing is ended.

In a case where the sheets are long in the conveying direction as large-sized sheets and the front ends thereof cannot be butted against the front end butting members 174 (see FIG. 1 and FIG. 9) to align them, the sheets are ejected onto the stacking tray by reducing the number of sheets to be overlapped together on the buffer roller 5 to be less than in the case of normal-sized sheets, whereby alignment failures can be prevented.

When it is judged that the length in the conveying direction is not longer than 297 mm, based on information showing the operation mode of the finisher 1 inputted from the main apparatus control unit 950 in response to operation of the operating section 308, it is judged whether or not the operation mode is the non-sorting mode (Step S904). When the operation mode is judged as the non-sorting mode, the winding counter value is set to 2 (Step S905), and the winding counter set processing is ended. Furthermore, in a case where it is judged that the operation mode is not the non-sorting mode (the operation mode is the sorting mode or staple sorting mode), the winding counter is set to 1 (Step S906), and the winding counter set processing is ended.

Herein, a reason why a larger winding counter value (the number of sheets to be winded around the buffer roller 5) is set in the non-sorting mode rather than in the sorting mode is that the sheet conveying speed is lower and left as is, the sheet conveying interval becomes shorter (narrower) in the non-sorting mode than in the sorting mode as mentioned above, so that it is required that the sheet conveying interval is larger (wider) in the non-sorting mode than in the sorting mode.

Furthermore, a reason for the lower sheet conveying speed in the non-sorting mode than in the sorting mode is as follows. Two methods exist for ejecting sheets to the finisher 1 from the main apparatus 300, that is, surface ejection in which sheets are ejected by turning surfaces with images formed upward, and inverting ejection in which sheets are ejected by being inverted by the sheet inverting pass 930 (see FIG. 1 and FIG. 10), wherein surfaces with images formed face down. When sheets are ejected onto the sample tray 201 in the non-sorting mode, they are ejected according to surface ejection so that the images can be visually checked. On the other-hand, sheets are inverted and ejected in the sorting mode so as not to disturb the page order.

When sheets to be ejected according to surface ejection are large-sized sheets, for example, A3-sized sheets, the front ends of the sheets may enter the finisher 1 during image formation due to the length of the sheet pass. Therefore, the speed of sheet conveyance into the finisher 1 in the case of surface ejection is a processing speed (speed when images are formed on sheets) lower than the inverting ejection speed.

Namely, the sheet conveying speed in the non-sorting mode in which sheets are ejected according to surface ejection is lower than that in the sorting mode in which sheets are ejected according to inverting ejection.

Furthermore, another reason why a larger winding counter value (the number of sheets to be winded around the buffer roller 5) is set in the non-sorting mode than in the sorting mode is that, as aforementioned, in the case of the non-sorting mode in which sheets are ejected onto the sample tray 201 without being aligned by the aligning unit 140, sheets are ejected onto the sample tray 201 upon increasing the number of sheets to be overlapped together to be larger than in the sorting mode in which sheets are ejected onto the stacking tray 200 after being aligned by the aligning unit 140, whereby stacking failures can be suppressed by lengthening the sheet static stopping time in ejection onto the sample tray 201 without alignment processing.

Furthermore, in the embodiment, a case is described where the number of sheets to be overlapped together (winding counter value) on the buffer roller 5 is the same in the sorting mode and the staple sorting mode, however, in a case where the staple sorting mode takes a longer time for processing than in the sorting mode, the number of sheets to be overlapped together in the staple sorting mode may be larger than in the sorting mode.

In the sheet processing unit (finisher 1) in this embodiment described as above, sheets are conveyed to the processing tray unit 129 that is an ejecting mechanism after at least two or more sheets are overlapped together on the buffer roller 5 (and depressing rollers 12, 13, and 14) that is a sheet overlapping mechanism and then ejected onto the stacking tray 200 that is a stacking member, whereby the interval (time) of sheet conveying to the processing tray unit 129 can be lengthened in comparison with the sheet delivery interval from the main apparatus 300, whereby sufficient time can be secured to align, sort, and staple sheets at the aligning unit 140 and eject sheets onto the stacking tray 200.

Furthermore, by changing the number of sheets to be winded around the buffer roller 5 (overlapping number) in accordance with the operating conditions of the finisher 1 such as the operation mode of the finisher 1 and the sheet type (that is, the ejection pattern of the finisher 1 typified by the non-sorting mode and the sorting mode, the sheet print type determined by the print mode of the main apparatus 1, and the sheet form such as the sheet size and thickness), the interval of sheet conveying to the processing tray unit 129 can be controlled to be optimum for the operating conditions.

Furthermore, as a unit to input information on the operating conditions of the finisher 1 into the finisher control unit 501, as well as the communications IC unit 510 which receives information from the main apparatus control unit 950 and the operating section 350 (provided at the finisher 1) which are described in the above embodiment, it is also possible that a detector which detects the sheet size and weight (thickness) is provided and used.

Particularly, in a case where a plurality of stacking members (sample tray 201 and stacking tray 200) are provided and sheets are ejected onto the stacking member (sample tray 201) without alignment, the number of sheets to be overlapped together before being conveyed to the ejecting mechanism is increased to be larger than in the case where sheets are ejected onto the stacking member (stacking tray 200) through the alignment processing, whereby stacking failures that may occur when sheets are ejected onto the stacking member without alignment can be suppressed.

Furthermore, in the sheet processing unit of this embodiment, in a case where sheets are large-sized sheets being long in the conveying direction and it is difficult to align them by butting the front ends of the sheets against the front end butting members 174, sheet aligning failures can be suppressed by reducing the number of sheets to be overlapped together on the buffer roller 5.

What is claimed is:

1. A sheet processing unit comprising:

a sheet overlapping mechanism which overlaps a plurality of sheets;

a conveying mechanism which conveys the sheets from the sheet overlapping mechanism;

a plurality of ejecting mechanisms which eject the sheets conveyed from by the conveying mechanism;

a stacking member on which the sheets ejected from the ejecting mechanisms are stacked; and a control unit which controls operations of the sheet overlapping mechanism, the conveying mechanism, and the ejecting mechanisms, wherein the control unit controls so that, when a predetermined number of sheets are stacked on the stacking member, the sheets to be ejected are always divided into at least two sheets each, overlapped together, and wherein the control unit controls so that a number of sheets to be overlapped at the sheet overlapping mechanism is changed in accordance with information on a plurality of ejection modes corresponding to the ejecting mechanisms.

2. The sheet processing unit according to claim 1, wherein the ejecting mechanisms can eject sheets in a first ejection mode performing alignment of sheets or a second ejection mode without performing alignment thereof.

3. The sheet processing unit according to claim 2, wherein the control unit sets a larger number of sheets to be overlapped together at the sheet overlapping mechanism in the second ejection mode than in the first ejection mode.

4. The sheet processing unit according to claim 1, further comprising an input unit, wherein the input unit has an operating key and inputs the information on the ejection modes corresponding to operation of the operating key into the control unit.

5. The sheet processing unit according to claim 1, further comprising an input unit, wherein the input unit inputs the information on the ejection modes received from the outside into the control unit.

6. The sheet processing unit according to claim 2, further comprising a processing tray unit which performs alignment of sheets, wherein the aligned sheets are ejected from the processing tray unit by one of the ejection mechanisms.

7. The sheet processing unit according to claim 2, wherein the stacking member comprises a first stacking tray on which sheets ejected in the first ejection mode are stacked; and a second stacking tray on which sheets ejected in the second ejection mode are stacked.

8. An image forming apparatus comprising:

a main body of the image forming apparatus which forms images on sheets;

the sheet processing unit according to claim 1, which processes sheets on which images have been formed by the main body.

9. An image forming apparatus comprising:

a main body of the image forming apparatus which forms images on sheets; and the sheet processing unit according to claim 1, which processes sheets on which images have been formed by the main body, wherein the control unit of the sheet processing unit receives the information on the ejection modes from the main body.

10. The sheet processing unit according to claim 7, wherein the first stacking tray has a butting member which is movable between a position which front ends of the sheets can butt against and a position which the front ends of the sheets cannot butt against.

11. A sheet processing unit comprising:

a sheet overlapping mechanism which overlaps a plurality of sheets;

a conveying mechanism which conveys the sheets from the sheet overlapping mechanism;

an ejecting mechanism which ejects the sheets conveyed by the conveying mechanism;

a stacking member on which the sheets ejected from the ejecting mechanism are stacked; and a control unit which controls operations of the sheet overlapping mechanism, the conveying mechanism, and the ejecting mechanism, wherein the control unit controls so that, when a predetermined number of sheets are stacked on the stacking member, the sheets to be ejected are always divided into at least two sheets each, overlapped together, and wherein the control unit controls so that a number of sheets to be overlapped at the sheet overlapping mechanism is changed in accordance with information on a first ejection mode performing alignment of sheets and a second ejection mode without performing alignment thereof.

12. The sheet processing unit according to claim 11, wherein the control unit sets a larger number of sheets to be overlapped together at the sheet overlapping mechanism in the second ejection mode than in the first ejection mode.

13. An image forming apparatus comprising:

a main body of the image forming apparatus which forms images on sheets; and the sheet processing unit according to claim 11, which processes sheets on which images have been formed by the main body, wherein the control unit of the sheet processing unit receives the information on the first and the second ejection modes from the main body.

* * * * *

UNITED STATES PATENT AND TRADEMARK OFFICE

CERTIFICATE OF CORRECTION

PATENT NO. : 7,011,306 B2
APPLICATION NO. : 10/397513
DATED : March 14, 2006
INVENTOR(S) : Hitoshi Kato et al.

It is certified that error appears in the above-identified patent and that said Letters Patent is hereby corrected as shown below:

COVER PAGE AT ITEM [75]:
Inventors, "Hitoshi Kato, Tokyo (JP); Wataru Kawata, Tokyo (JP)" should read --Hitoshi Kato, Ibaraki (JP); Wataru Kawata, Chiba (JP)--.

SHEET NO. 20 of 23:
Figure 20, "ATACKING" should read --STACKING--.

COLUMN 4:
Line 27, "winded" should read --wound--.

COLUMN 5:
Line 3, "Is" should read --is--.

COLUMN 8:
Line 61, "pared" should read --paired--.

COLUMN 9:
Line 2, "rails" should read --rail--.
Line 22, "actuate" should read --actuates--.

COLUMN 13:
Line 8, "winded" should read --wound--.
Line 19, "winded" should read --wound--.
Line 58, "winded" should read --wound--.
Line 59, "Is" should read --is--.
Line 60, "winded" should read --wounded--.

COLUMN 14:
Line 40, "winded" should read --wounded--.
Line 44, "winded" should read --wounded--.

COLUMN 15:
Line 37, "winded" should read --wounded--.
Line 47, "winded" should read --wounded--.
Line 62, "winded" should read --wounded--.

COLUMN 16:
Line 4, "winded" should read --wounded--.
Line 5, "winded" should read --wounded--.
Line 34, "winded" should read --wounded--.

UNITED STATES PATENT AND TRADEMARK OFFICE

CERTIFICATE OF CORRECTION

PATENT NO. : 7,011,306 B2
APPLICATION NO. : 10/397513
DATED : March 14, 2006
INVENTOR(S) : Hitoshi Kato et al.

It is certified that error appears in the above-identified patent and that said Letters Patent is hereby corrected as shown below:

COLUMN 17:
Line 2, “winded” should read --wounded--.
Line 5, “winded” should read --wound--.
Line 26, “Is winded” should read --is wound--.
Line 34, “winded” should read --wound--.

COLUMN 18:
Line 34, “winded” should read --wound--.
Line 41, “winded” should read --wound--.

COLUMN 20:
Line 38, “S604). Namely” should read --S604), namely--.

COLUMN 21:
Line 19, “winded” should read --wound--.
Line 21, “winded” should read --wound--.
Line 24, “winded” should read --wound--.
Line 27, “winded” should read --wound--.
Line 29, “winded” should read --wound--.
Line 32, “winded” should read --wound--.
Line 39, “winded” should read --wound--.
Line 52, “winded” should read --wound--.
Line 54, “winded” should read --wound--.

COLUMN 23:
Line 6, “winded” should read --wound--.
Line 22, “formed” should read --are formed--.
Line 40, “winded” should read --wound--.

COLUMN 24:
Line 6, “winded” should read --wound--.
Line 48, “from” should be deleted.

UNITED STATES PATENT AND TRADEMARK OFFICE

CERTIFICATE OF CORRECTION

PATENT NO. : 7,011,306 B2
APPLICATION NO. : 10/397513
DATED : March 14, 2006
INVENTOR(S) : Hitoshi Kato et al.

It is certified that error appears in the above-identified patent and that said Letters Patent is hereby corrected as shown below:

COLUMN 25:
Line 20, "comprises" should read --comprises:--.
Line 27, "sheets;" should read --sheets; and--.
Line 41, "which front" should read --which the front--.

Signed and Sealed this

Fifth Day of September, 2006

JON W. DUDAS
*Director of the United States Patent and Trademark Office*